United States Patent [19]

David

[11] Patent Number: 4,683,541

[45] Date of Patent: Jul. 28, 1987

[54] ROTARY FLUIDIZED BED COMBUSTION SYSTEM

[76] Inventor: Constant V. David, 4952 Field St., San Diego, Calif. 92110

[21] Appl. No.: 711,287

[22] Filed: Mar. 13, 1985

[51] Int. Cl.[4] ..... G06F 15/20; F23G 5/00

[52] U.S. Cl. ..... 364/500; 364/503; 110/264; 110/347; 110/188; 431/9; 431/173

[58] Field of Search ..... 364/500, 503; 110/264, 110/347, 188; 431/9, 173

[56] References Cited

U.S. PATENT DOCUMENTS

| | | | |
|---|---|---|---|
| 3,627,287 | 12/1971 | Herz | 364/503 |
| 4,147,116 | 4/1979 | Graybill | 110/264 |
| 4,430,719 | 2/1984 | Pearson | 364/500 |
| 4,453,474 | 6/1984 | Lewis | 110/188 |
| 4,561,364 | 12/1985 | Green et al. | 110/264 |

FOREIGN PATENT DOCUMENTS

| | | | |
|---|---|---|---|
| 0303226 | 1/1929 | United Kingdom | 110/264 |

*Primary Examiner*—Parshotam S. Lall

[57] ABSTRACT

A rotary fluidized bed combustion system in which air and particulate solid fuel are introduced and mixed. The mixture is caused to rotate to generate an artificially induced gravitational field. Some of the air is introduced so as to flow inwardly at a later time in a manner such that it interacts aerodynamically with the fuel particles which are propelled outwardly by the centrifugal forces caused by the artificial gravitational field, thus generating a fluidized bed effect for the particles. The fuel and air chemically react and combustion results. As the fuel particles burn, their sizes decrease and they are slowly pushed inwardly by the gas flow which is forced to follow an elongated path around generally conical surfaces of decreasing radii, toward the exhaust vent. The residence time of the fuel particles, inside the combustion region, is thereby increased. The combustion effectiveness of the fuel is thus considerably improved and no recycling of the unburned fuel particles is then required.

14 Claims, 26 Drawing Figures

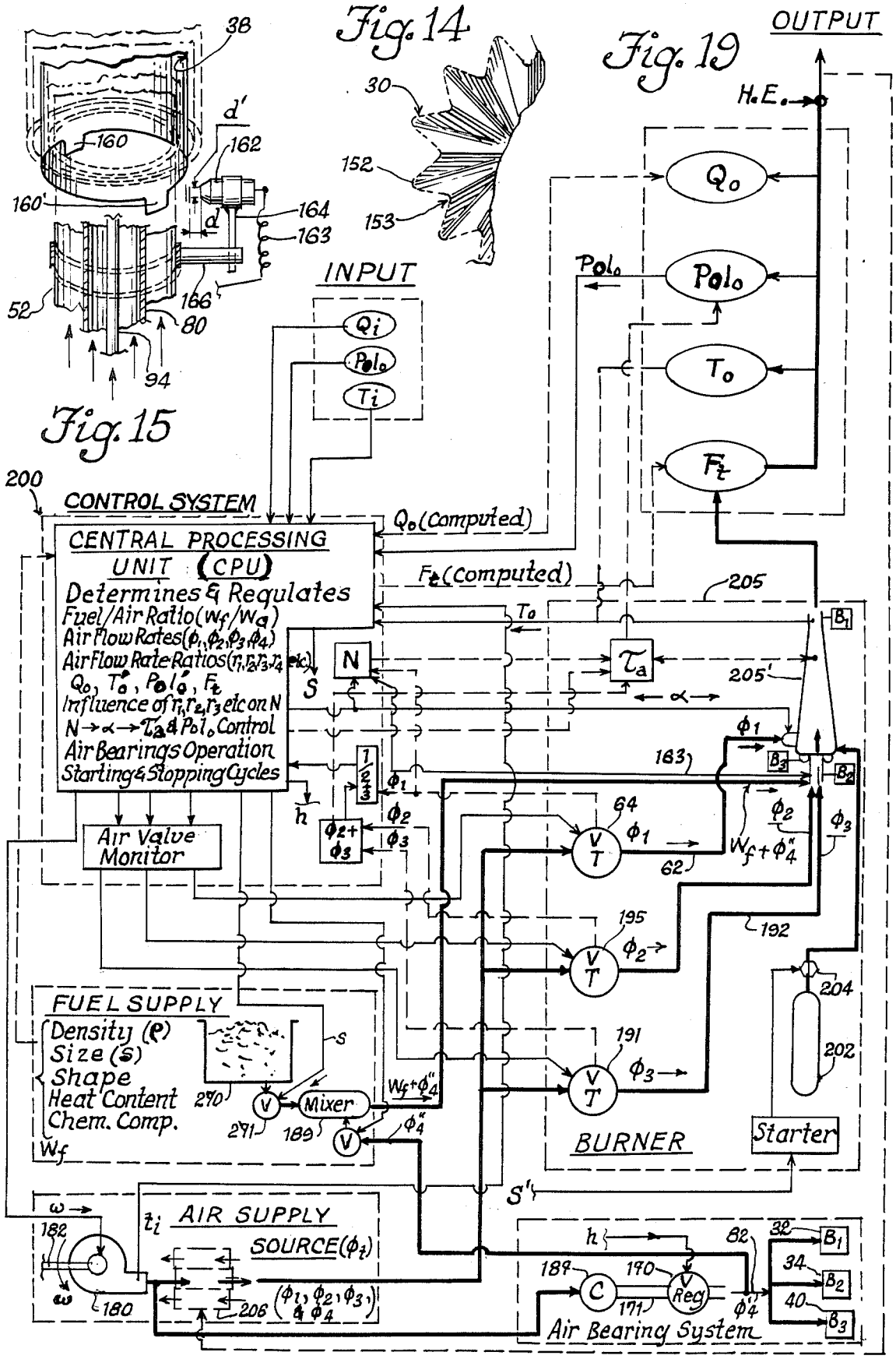
Fig. 14
Fig. 15
Fig. 19
OUTPUT
H.E.
INPUT
CONTROL SYSTEM
CENTRAL PROCESSING UNIT (CPU)
Determines & Regulates
Fuel/Air Ratio
Air Flow Rates
Air Flow Rate Ratios
Influence of
Air Bearings Operation
Starting & Stopping Cycles
Air Valve Monitor
FUEL SUPPLY
Density (ρ)
Size (s)
Shape
Heat Content
Chem. Comp.
Mixer
BURNER
Starter
AIR SUPPLY
SOURCE
Air Bearing System
Reg
Qo(Computed)
Ft(Computed)

300
302
304
306
308
310
312
314
316
318
320
322
324
326
328
330
332
334
336
338
339
340
342
344
346
348
350
351
353
354
356
357
358
359
401

CENTRAL PROCESSING UNIT (CPU)
INPUT PORTS ASS'Y 406
COMPUTER 410
OUTPUT PORTS ASS'Y 408
Q_o (Computed)
Pol_o
T_o
Wa_1
Q_i
T_i
Pol_i
Wf + Wa_2
Wa_3
Wf
Wa_2
Wa
N
400
402
404
412
414
415
416
417
418
419
420
422
424
425
426
428
430
432
356
314
336
300
370
380
381
389
392

300
318
320
322
324
326
328
330
353
354
314
389

370
372
381
374
384
382
386
376
378
380
388
390
392
394
396
398

338
339

40
322
304
300
324

ROTARY FLUIDIZED BED COMBUSTION SYSTEM

FIELD OF THE INVENTION

The present invention relates to a combustion system and a method to burn solid fuel in particulate form in air, and more particularly to a combustion system in which the fuel particles are forced to remain suspended and floating in air while they burn, whereby a fluidized bed is thus formed by the mixture of air, combusted gases and partially burned particles.

DISCUSSION OF THE PRIOR ART

Burning solid fuel particles in a flow of air, resulting in a combustion process, has now been used for some time in a manner commonly referred to as fluidized bed combustion. The combustion of solid fuel in the form of small particles creates a high ratio of fuel/air contact area to fuel volume. The combustion can thus yield a high heat production rate per unit of volume of the combustion region. The fuel particles, as they burn, if the air flow is ascending vertically, tend to fall down in the air, because of gravity. The relative velocity of the particles with respect to the air generates an aerodynamic lifting force exerted upwardly on the particles. When the gravity force is equal to the aerodynamic force, the particles appear still with respect to the structure surrounding and containing the combustion process, for they have then reached their terminal velocities. As they burn, the particles become smaller and their terminal velocities decrease, which means that these partially burned particles then move upwardly with respect to those particles which have remained larger. The velocity of the air surrounding the small particles can then be decreased accordingly, to prevent the blowing out of these smaller partially burned particles. This can be achieved by shaping the containing walls to cause the air flow sectional area to increase, as the distance between the region where the air is introduced and these partially burned particles increases (diverging shape).

The terminal velocity mentioned above varies from particle to particle because it is function, for a given fuel nature, of the particle size and shape. The fuel consists of particles of various sizes and shapes, within a range, at the time it is introduced into the combustion system. Therefore, the combustion region where the surrounding gas relative velocity cannot be the same for all particles in a given location at a given time. This results in particles being forced out of the combustion of these particles occurs at a rate which varies from particle to particle and necessarily in locations within the combustion region before they have had time to burn completely. In such a simple fluidized bed combustion system, a large proportion of the fuel emerges from the combustion system in the combusted gases unburned. The two main consequences are: (1) a combustion process less efficient than is desirable; and (2) combusted gases containing too many solid particles (particulate pollutant) which have deleterious effects on the environment. The object of fuel burning is usually to produce usable heat and eventually power. The combusted gases must then pass through a heat exchanger for this heat to be extracted. These unburned residual particles have an erosive action on the components of the heat exchanger, which is unacceptable usually. The second consequence makes it thus more mandatory than does the first that the combusted gases contain a minimal amount of particulate by-products. A third consequence is of course the pollution of the atmosphere with objectionable and often unacceptable dust.

Two basic systems are currently used to eliminate or minimize the amount of unburned fuel particles present in the combusted gases when they finally exhaust into the atmosphere: (1) separating these residual particles from the gases by centrifugation in a cyclone dust separator, whereby the separated particles are reintroduced as fuel in the combustion system; and (2) concentrating the residual particles in a portion of the gases and recycling that portion of the combusted gases into the combustion system in addition to the fresh air and fuel required, whereby only that portion of combusted gases with a much lower particle content is then ducted into the heat exchanger.

Both approaches, the cyclone separation and the gas recycling, thus require additional machinery and increased complexity resulting in higher costs of power production. Some unburned fuel particles still escape and reach the heat exchanger. Neither approach provides a truly acceptable combustion process.

SUMMARY OF THE INVENTION

A primary object of the present invention is to provide an improved combustion system for burning particulate solid fuel in a fluidized bed which will facilitate the completion of the combustion process of all particles before the combusted gases leave the combustion system.

Another object of the present invention is to provide automatically a sorting out of the fuel particles in the combustion system according to their sizes, which automatically adjusts the residence time of the particles in the combustion region to their sizes and insure that most particles, regardless of size, are given enough appropriate time to burn before their exhaust.

Still another object of this invention is to provide a combustion system which will require only one passage of the fuel particles through the combustion system and still maintain the particulate content of the combusted gases below the acceptable pollution level.

Yet another object of the invention is to provide a control adaptive combustion system which will automatically regulate the combustion process to maintain a selected but adjustable heat output rate, exhaust gas temperature and particulate pollutant content, independently of the nature of the particulate fuel.

Accordingly, the present invention relates to apparatus and method for burning solid fuel in particle form inside a combustion system, which include the operative steps of: (a) introducing air and fuel inside a combustion region; (b) causing the fuel/air mixture enclosed and contained within walls to form the combustion region which rotates; (c) imparting an angular momentum to some of the air constituting said fuel/air mixture; (d) generating aerodynamic forces acting inwardly on the thus outwardly centrifugated particles, by some of the air introduced in a specified manner; (e) channelling the fuel/air mixture within the combustion region in a manner such that larger particles are forced to follow a path longer than that followed by the small particles; and (f) regulating indirectly the rotation speed of the fuel/air mixture so as to maintain an optimum mode of operation of the combustion system. Also, some of the air introduced into the combustion region cools and protect the walls surrounding the combustion region by preventing contact between the burning fuel particles and the walls, while the fluidized bed effect is thus created.

The burning fuel particles are continuously subjected to two opposite forces, centrifugal and aerodynamic, until they leave the combustion region. The ratio of these two forces is caused to decrease automatically as the particle burns and becomes smaller, thereby causing smaller particles to exit faster along a shorter path. The residence time (or combustion time) of each particle thus is automatically adjusted to maximize the probability of each particle being completely burned before it leaves the combustion region, under all predictable combustion system operation conditions and for all expected particle sizes, densities and shapes.

BRIEF DESCRIPTION OF THE DRAWINGS

The objects, advantages and features of this invention will be more readily understood from the following detailed description when read in conjunction with the accompanying drawings, in which:

FIG. 14 is a partial sectional plan view of the inner rotating wall taken along section line 14—14 of FIG. 1;

FIG. 15 is a partial perspective and midsectional elevation view of the rotating wall angular velocity detecting mechanism;

FIG. 19 is a detailed block diagram of one form of control system of the invention as applied to the structure illustrated in FIGS. 1 through 15;

DESCRIPTION OF THE PREFERRED EMBODIMENT

Figure 1:
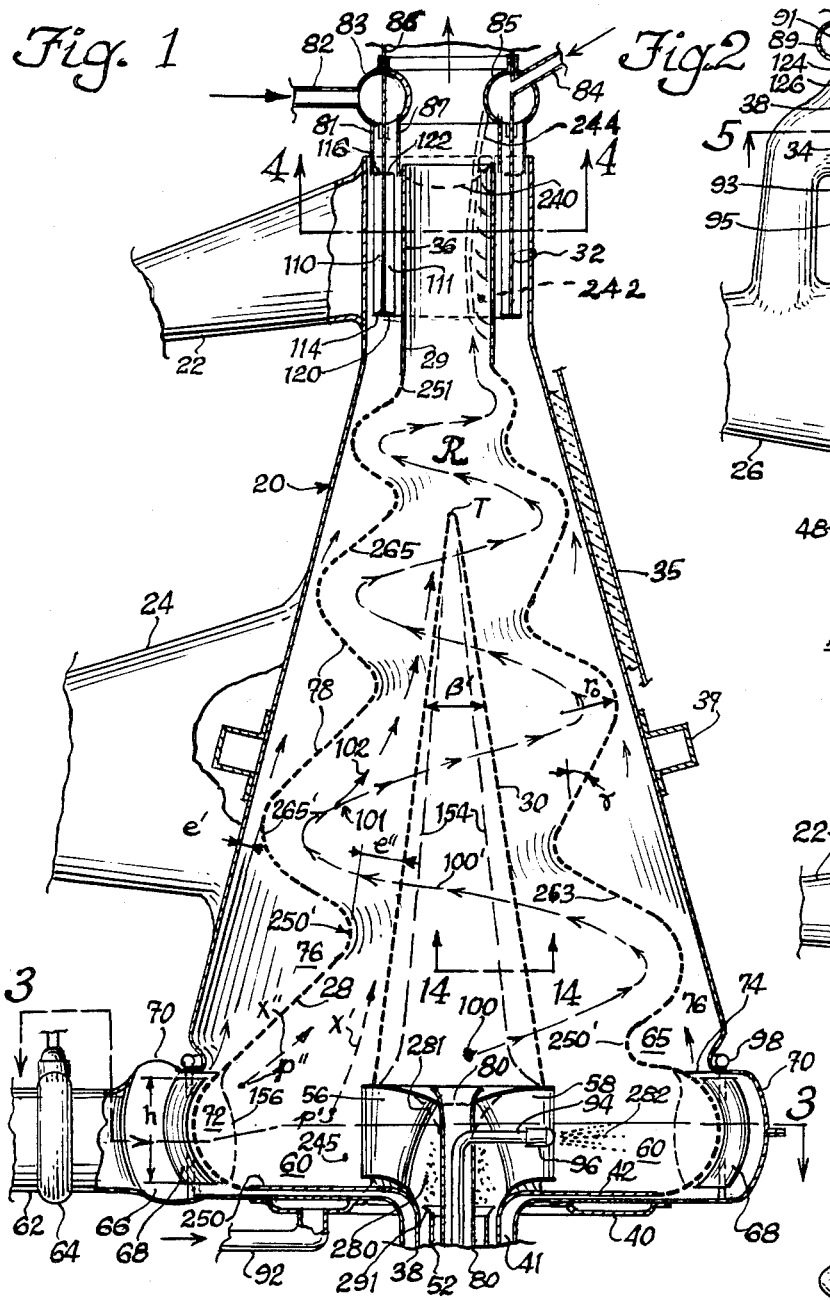
FIG. 1 is a midsectional elevation view of a preferred embodiment of the combustion system of the present invention.
Figure 2:
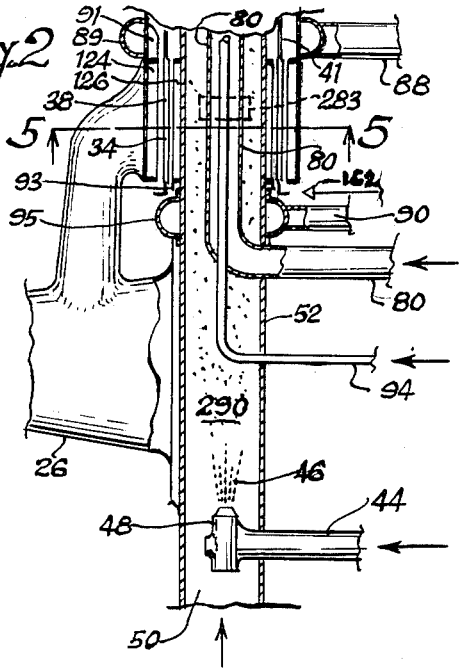
FIG. 2 is a midsectional elevation view of the combustion system embodiment part of FIG. 1 where fuel is introduced.
Figure 3:
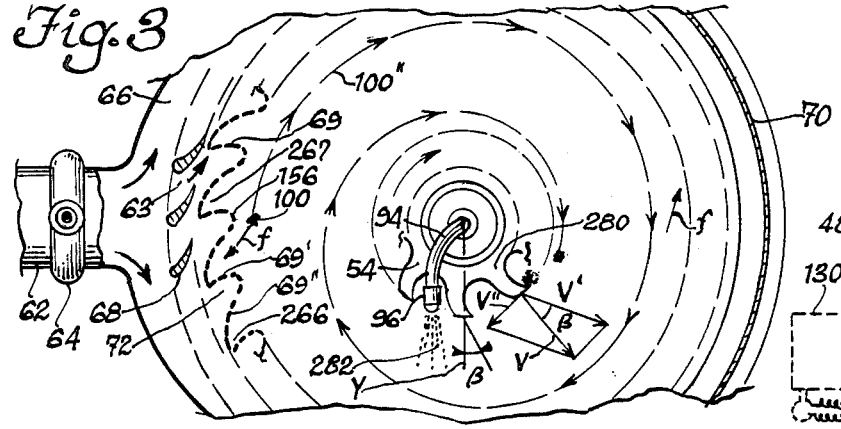
FIG. 3 is a partial sectional plan view taken along section line 3—3 of FIG. 1.

Referring to FIGS. 1, 2 and 3, in accordance with the present invention, an outer structure shell 20 supported by members 22, 24 and 26 houses rotating outer wall 28 and inner wall 30 which are centered and positioned by air bearings 32 and 34, in which journaled cylinders 36 and 38, integrally part of outer wall 28, are guided. Shell 20 is thermally insulated externally by jacket 35 and reinforced by circular rib 37. The axis of rotation of the rotating walls is shown in the vertical position and the weight of the walls is then supported by flat air bearing 40 by means of flat flange 42 which is part of shell 20. The particulate fuel is introduced by duct 44 in which the fuel particles 46 are suspended and transported by air under pressure. The particles are injected by nozzle 48 into an air stream 50, where further dilution of the fuel particles in air takes place. This stream is ducted by pipe 52 and then forced to flare out by a plurality of specially shaped nozzles 54 formed by contoured walls 56 and 58. At this juncture, the fuel particles enter region 60 wherein combustion of the fuel is initiated.

Most of the air needed for the combustion is introduced by duct 62 equipped with a control valve 64 into chamber 66 surrounding a set of guide vanes 68 and contained by wall 70. Vanes 68 channel the air to flow in two consecutive directions shown by arrows 63 and 65. The air thus channelled first impacts a plurality of turbine-blade-like protuberances 69 formed by the special contours given to wall 28 in that location, then is allowed to proceed further through a plurality of gaps 72 formed by and located between contiguous blade surfaces 69' and 69'', for example, which present openings through gap 74 into chamber 76 located between shell 20 and outer rotating wall 28. This air under pressure is allowed to permeate wall 28 which has a porous texture. Wall 28 is shaped to form an elongated convolution 78 which is helically wound around an imaginary supporting conical surface. Both the helix pitch and the size of the convolution cross-section are established to present a tapering off channel to the combusted gases. At the top, wall 28 merges into journaled portion 36 of gas collection pipe 29 wall, and at the bottom, wall 28 merges into flat flange 42 which ends into the other journaled cylindrical admission pipe 41 wall. Inner rotating wall 30 which is also porous helps channel some air into the combustion region and gives it its special and desirable shape. This air is brought under pressure by duct 80 which is positioned concentrically to fixed admission pipe 52.

Air under pressure is brought to air bearing 32 by ducts 82 and 84 mounted on exhaust vent pipe 86 which ducts the combusted gases to a heat exchanger. Air under pressure is also ducted to air bearing 34 by ducts 88 and 90 attached to the supporting structure and pipe 52 respectively. Flat air bearing 40 is air fed by duct 92. The fuel needed to start the combustion of the fuel particles is fed by tube 94 to an injection nozzle 96 located between two air nozzles 54. Guide vanes 68 can rotate and are actuated by actuating mechanism 98 shown only schematically. Whenever the combustion system is in operation, a typical large particle such as 100 may follow a path such as 100'. If the particle is smaller or has burned fast, it may depart from path 100' at point 101 and then follow a shorter more direct path such as 102 toward the exhaust. Path 100' of FIG. 1 appears as a spiral 100'' in the projected plan view of FIG. 3.

Figure 4:
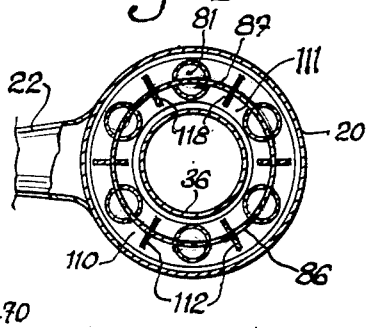
FIG. 4 is a sectional view of the exhaust end air bearing taken along section line 4—4 of FIG. 1.
Figure 5:
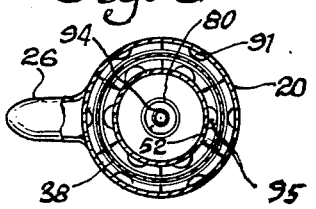
FIG. 5 is a sectional view of the admission end air bearing taken along section line 5—5 of FIG. 1.

Further details of the cylindrical air bearings are shown in FIGS. 4 and 5. Ducts 82 and 84 are shown feeding manifolds 83 and 85 respectively. Ducts 88 and 94 are shown feeding manifolds 89 and 91 respectively. All of these manifolds vent into a plurality of air feed channels such as 81 and 87 for bearing 32, and 91 and 95 for bearing 34. In the embodiment configurations shown, each bearing side consists of six air cushions, each being fed by its own air feed channel. For air bearing 32 (FIG. 4), the outer air cushions 110 are formed cooperatively by shell 20, wall 86, middle partitions 112 fixed to wall 86, and end walls 114 and 116. The inner air cushons 111 are formed cooperatively by wall 36, wall 86, middle partitions 118 fixed to wall 86, and end walls 120 and 122. A similar configuration is shown for air bearing 34 where the air cushions 124 and 126 are inverted and are positioned on both sides of journaled wall 38 (FIG. 5).

Figure 6:
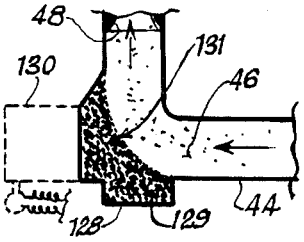
FIG. 6 is a diagrammatic illustration of the manner in which the particulate solid fuel suspended in an air flow is forced to make a 90-degree turn with minimal ensuing abrasion.

Referring now to FIG. 6, the schematic details of the particulate fuel ducting, when forced to make a direction change, are illustrated. To prevent erosion (or abrasion) of the duct wall inner surface by the flowing particles, a trap 128 is used and allows some particles to compact within space 129, forming a protective buffer and which eventually assumes the shape of a guiding surface such as 131. To eliminate complete clogging of the duct elbow, a vibrator 130 mounted on one side of trap 128 may be used to insure that enough room is always left between surface 131 and the elbow wall for providing an adequate passage for the fuel/air mixture.

Figure 7:
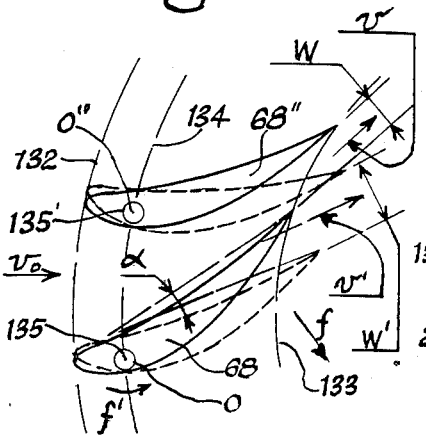
FIG. 7 is a detailed diagrammatic illustration of air ducting through guide vanes.

Additional details on the operation of guide vanes 68 are illustrated in FIG. 7. A pair of vanes 68 and 68'' are shown in solid lines in a position which deflects the passing air by an angle greater than that which the same vanes shown in phantom lines, in a wider opened position, would. Arcs 132 and 133 also shown in phantom lines represent part of the circles which correspond to the positions assumed by of all leading edges and trailing edges of vanes 68, respectively. Arc 134 corresponds to the circle on which the centers of rotation such as 0 and 0'' of the vane articulation shafts are located. Circle 134 is fixed, but circles 132, and especially 133, vary in size as the vanes are caused to rotate around their axes.

Figure 8:
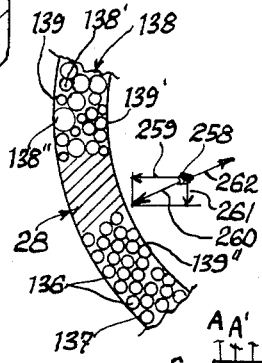
FIG. 8 is a partial sectional view of the rotating walls showing a sintered structure.
Figure 9:
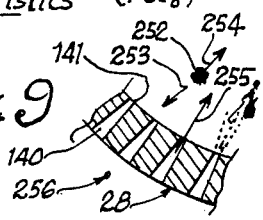
FIG. 9 is a partial sectional view of the rotating walls showing a drilled structure.

Referring to FIGS. 8 and 9, two types of porous wall configurations are illustrated, in partial typical cross-sections of wall 28. In FIG. 8, sintered balls are shown forming the full thickness of wall 28. These solid balls can be of substantially identical size (136) or of varying sizes (138). The interstices left between the balls after the sintering process, such as 137 or 139, provide the channels through which the air flows across the wall thickness. The contact points and surfaces between adcent balls provides the structural continuity required to give wall 28 its integrity and strength. In FIG. 9, a plurality of conical holes are formed through wall 28 thickness. These holes taper as the air flows and present their smallest end to the combustion region where the fuel particles burn (141). Air enters through openings such as 140. In both porosity configurations, the degree of air passage offered to the air varies according to position for all locations on wall 28 surface.

Figure 10:
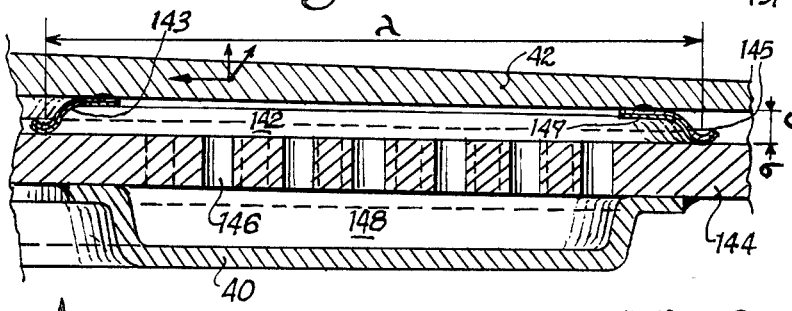
FIG. 10 is a partial sectional view of a flat air bearing.
Figure 13:
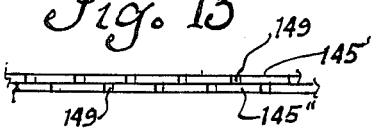
FIG. 13 is a partial end view of a flexible sliding air seal used in conjunction with air bearings.
Figure 12:
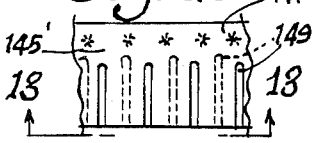
FIG. 12 is a partial plan view of a flexible sliding air seal used in conjunction with air bearings.

Referring now to FIGS. 10, 11, 12 and 13, details of flat air bearing 40 and of typical sliding seals are illustrated. In FIG. 10, a cross-section of the flat air bearing which forms an annular air cushion 142 is depicted located between two concentrically positioned flexible sliding air seals 143 and 145, affixed to wall 45 by means of flanges 147 and sliding on fixed wall 144. Air under pressure is fed to air cuhion 142 through supply holes 146. Annular manifold 148, connected to air duct 92 (FIG. 1), distributes the pressurized air to air cushion 142. Air seals 145 consist of two circular flexible specially formed springy metallic bands 145' and 145'', solidly attached to the lower surface of wall 42 and pushing against the fixed upper surface of wall 144. The seal configuration, as shown, can be reversed, whereby the seal is then solidly attached to wall 144 and sliding against wall 42, without altering the seal operation and changing its function. The formed metallic bands 145' and 145'' have built-in springiness in a way such that the seal is allowed to deform and bend in the direction of arrow f so that the distance between walls 42 and 144 can vary as needed. The deformation required of the springy lips formed by the free edges of bands 145' and 145'' is made possible by means of slots such as 149 cut into both lips all the way to flange 147, at intervals as shown in FIGS. 12 and 13 along the whole length of both bands. The two bands are positioned in a manner such that the slots cut in one band are staggered with respect to the slots cut in the other band, so that air leakage is always kept at a minimum. The only passage offered to the air out of air cushion 142 is located at the contact line formed by the locus of all points such as 150 and corresponds to the cross-section sum total area of all the slots cut in band 145''.

In order to facilitate the gyration of the fuel/air mixture in the combustion region, additional friction between the rotating walls and the mixture may be provided by shaping the contour of rotating wall 30 so that ridges such as 152 of FIG. 14 are formed around the wall conical surface and along a generatrix of the conical surface. The bottoms 153 where the adjacent walls of two contiguous ridges meet on their way inwardly are represented by phantom line contours 154 in FIG. 1. Such ridges do not hinder the flow of the particles along a path such as 102 but certainly help impart the angular momentum to the fuel/air mixture, as ridges 156 (bottoms between two adjacent blades 69) of wall 28 also do at the bottom portion of the combustion region.

Referring now to FIG. 15, the end of journal 38 wall is shown equipped with two tabs 160 and 160' which alternatively pass in front of the tip of sensor 162 held in position by adjustable stem 164 in association with support 166 shown mounted on fixed wall 52. The passage of tabs 160 and 160' in front of sensor 162 generates signals which are transmitted by signal line 34, for the configuration illustrated in FIG. 15. Both the length and width of these tabs are large enough to insure detection always by the tip of sensor 162 which is characterized by a diameter d', even when the distance between the tab surfaces and the sensor tip varies by the maximum amount d, and for any longitudinal or axial displacement that journal 38 wall may be subjected to.

Figure 16:
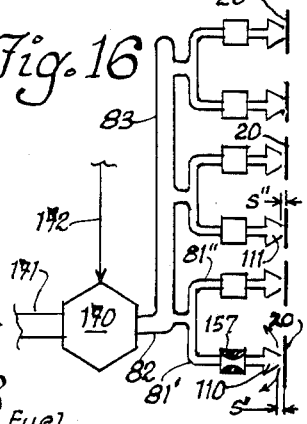
FIG. 16 is a diagrammatical illustration of the pressurized air ducting system used in an air bearing.

FIG. 16 illustrates the functional operation of a typical air bearing, for one side of such bearing. For ease of representation, wall 20 is shown developed flat and each air cushion is shown isolated from its contiguous neighbors. Typically, two air cushions such as 110 and 111 of FIG. 4, diametrically opposed, are depicted side by side for simplicity sake. Each air cushion is supplied in air under pressure by feed channels 81' and 81'' corresponding to air feed channel 81 of FIG. 4. Channels 81' and 81'' can be connected directly to manifold 83, or as shown for ease of understanding in FIG. 16, by a common connection. Each feed channel 81 is equipped with a restricting orifice 157. Manifold 83 is supplied with air at a constant regulated pressure by regulator 170 which is supplied with compressed air by air line 171 and adjusted by means of signal line 172. The short lines shown as the sides of air cushions 110 and 111, and both converging toward wall 20 outline, represent schematically in FIG. 16 the walls and partitions shown surrounding an air cushion in FIG. 4. The distances s' and s'' between the tip of these short lines and wall 20 represent the gaps that exist between the inner cylindrical surface of wall 20 and the tips of the separating partitions, and cushion end walls. The sum s'+s'' equal to s is constant and represents the diametrical clearance or total displacement permitted to wall 20 with respect to fixed wall 86 of the exhaust system.

Figure 17:
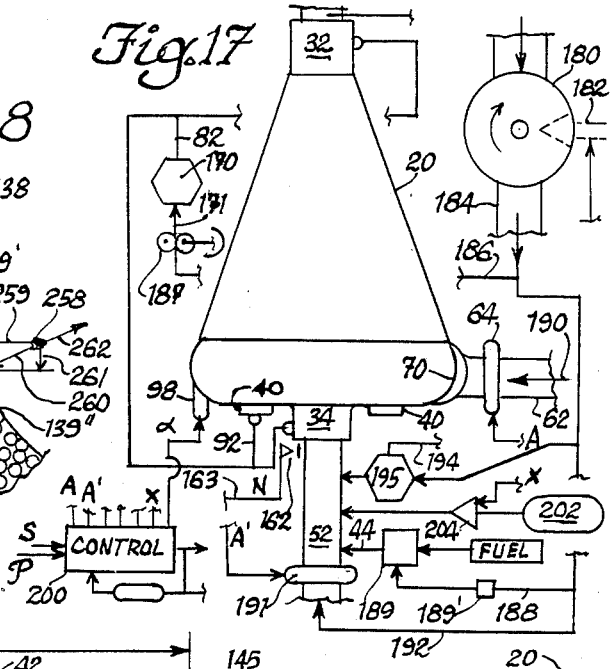
FIG. 17 is a simplified definitional diagram of the combustion system of the invention.

The complete combustion system and the components needed to operate it are represented diagrammatically in FIG. 17 which illustrates the manner in which these components are connected to the combustion system burner. An air blower 180, driven by power shaft 182 delivers air under pressure through duct 184. This total air flow is divided into four separate air flows: 186 to compressor 187 supplying air to the air bearings, 188 to operate the fuel supply system, 190 to supply air externally to the outer rotating wall 28, 192 to supply air to pipe 52, 194 to supply air internally to the inner rotating wall 30. Air supply 188 is regulated by control valve 189', air supply 192 is regulated by control valve 191. Each of these control valves, including valve 64, receive signals from master control 200. The guide vanes, actuated by mechanism 98, are also controlled by master control 200 which receives the signal generated by sensor 162. The fuel required to initiate the combustion of the particulate fuel is contained in tank 202 and a control valve 204 regulates and times the flow of this priming fuel.

Figure 18:
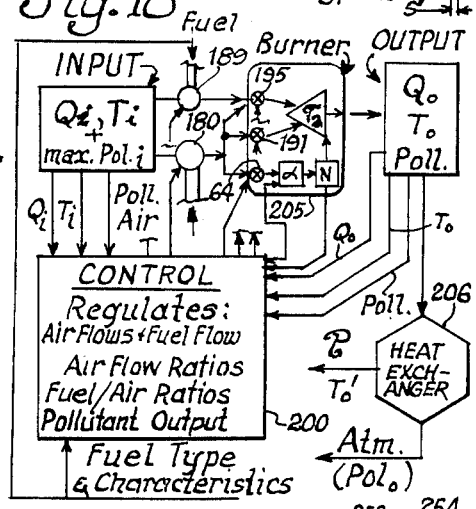
FIG. 18 is a simplified definitional diagram showing inputs and outputs in the combustion system operation.
Figure 11:
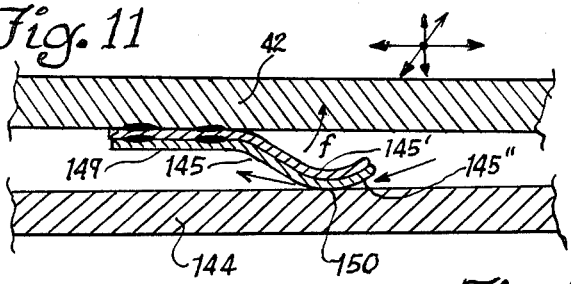
FIG. 11 is a detailed sectional view of a flexible sliding air seal used in conjunction with air bearings.

The simplified block diagram of FIG. 18 illustrates how the input and output signals which are received, processed and generated by master control 200 are used to monitor the operation of the combustion system burner 205. The input signals can be classified in two main groups: (1) fuel type and characteristics (physical and thermal); and (2) burner performance characterized by heat flow demand ($Q_i$), average combusted gas temperature ($T_i$) and maximum pollutant content acceptable (Poll.). The output signals are: (1) heat flow yield ($Q_o$); (2) associated average combusted gas temperature ($T_o$); (3) pollutant content of the combusted gases (poll.); and (4) the angular velocity (N) of the rotating walls. The output signals are fed back to master control 200 which then compares these output signals to the input signals, process their differences and generate signals accordingly to monitor: (1) the fuel flow; (2) the total air flow; (3) the openings of the three air flow valves; and (4) the guide vane angle setting ($\alpha$). Within the burner, the combination of air flow valve adjustments, guide vane setting (and resulting rotation speed of the fuel/air mixture) determines the mean residence time ($\tau_d$) of the fuel particles in the combustion region. This time $\tau_d$ chiefly influences the amount of particulate pollutants present in the combusted gases and, to less extent, $Q_o$ and $T_o$. The combusted gases are channelled to a heat exchanger 206 where heat is extracted to produce power $\mathcal{P}$ and gas exhausting at a reduced temperature $T_o'$ in the atmosphere.

Figure 20:
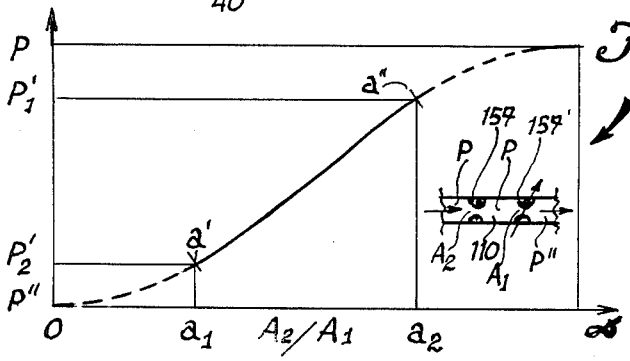
FIG. 20 is a graph showing the influence of the ratio of the sizes of two orifices in series on air pressure.

The detailed diagram shown in FIG. 19 is a combination of block diagram and flow chart indicating how the burner and the combustion system components are interconnected and interact. It is a composite of the information summarized in FIGS. 17 and 18, with the various interconnecting signal lines superimposed and showing the flow direction of these various signals. Signal lines are shown in thin solid lines, functional interacting lines are shown in thin phantom lines, and fuel and air ducts, pipes or lines leading to the combustioon region are shown in heavy solid lines. The contour outlines of the major components are shown in dotted lines. The individual components and/or operational devices used are shown schematically in solid lines. Input and output functions are represented inside blocks outlined in heavy phantom lines. The following sections explain and discuss in detail how the system operates and is controlled. The graph and the schematic of FIG. 20 illustrate the operation of the air bearings and indicate how the air pressure in a typical air cushion 110 varies as the gap available to the air for escaping varies (variable restricting orifice 157').

BURNER OPERATION OF THE PREFERRED EMBODIMENT

To be compact and efficient, a system for burning solid particulate fuel must facilitate the chemical reaction taking place between the particle surface and the surrounding gaseous oxidizer (burning process). This is best achieved by suspending the particle in a turbulent flow of this gaseous oxidizer (air). For the sake of simplication and ease of understanding, a small solid ball of coal can be imagined free falling and burning in air. To sustain the combustion of the coal, the surface of this ball must be hot enough to: (1) heat some of the surrounding air; (2) heat the subsuface of the coal; and (3) still keep a temperature such that a thin surface layer of the ball remains hot enough to be kept self igniting. When air flow conditions, type of fuel and particle size and shape are and remain within a critical range of values, the particle can then burn until it is entirely consumed, at which time only gaseous carbon monoxide (CO) and dioxide ($CO_2$) are left with nitrogen in the surrounding gas (combused gases), if no other extraneous chemical reaction takes place and if pure carbon is burned. Instead of one particle, a plurality of identicl particles can be visualized free falling in an ascending air flow that has a velocity equal to the free fall terminal velocity of the particles at a given time, in a given location. At that point, the force F exerted on each particle by the gravity field is equal to the aerodynamic drag D resulting from the air-to-particle relative velocity, assuming no extraneous physical interactions from neighboring particles and/or the combusted gases being produced. If the particle population in a given volume of air is such that all the fuel and all the oxygen present in that volume can react, a complete combustion can occur. Unfortunately, the real life process is necessarily somewhat more complex and less ideal. All particles do not have the same size and shape at that given time in that given location, they interfere with one another, the surrounding air flow turbulenc varies from place to place and some particles burn faster than others. The net result of this simplistic description of the combustion process just outlined is that the time required for particles to burn completely varies considerably from particle to particle and that the length of the path followed by some particles while they are still burning would exceed practical acceptable limits, if 100% combustion of 100% particles were to be burned when they leave the combustion region. Furthermore, to levitate properly, larger particles need higher air flow velocities than do smaller particles, which are then blown away.

One solution is to create self generating air turbulence in a way such that the air flow velocity actually varies considerably within a short distance. This is done practically by injecting the air through conical holes drilled in a solid plate as represented in FIG. 9, but with the holes being vertically positioned and the plate being in a flat and horizontal position, at the bottom of a vertical diverging pipe. The conical holes create local air jets such as j directed vertically. When particles are sprinkled at the top of such an air pipe, they fall down until they reach their free fall terminal velocity (small particles) or come near the flat surface at the bottom of the pipe (larger particles). The latter somehow are caught by the jet flows and become tossed up, fall back down, tossed up again, and so on while they burn and become smaller. Then they join smaller particles higher up and continue burning. The process of being tossed up and falling again (like a hailstone) creates the fluidized bed phenomenon, well known in the industry and used to coat particles with a carbon layer for instance, the way a hailstone adds a layer of ice every time it travels through one up-and-down cycle. In the present case, because a fuel particle is being burned, layers of burned material are removed in a continuous process, and possibly somewhat cyclic too. Because fuel and air are finely mixed in the combustion region of a fluidized bed, the air-to-fuel contact area per unit of volume of fuel/air mixture is much higher than that which can be achieved with bulk burning of solid fuel. Combustion is also more complete and yields a lower amount of particulate pollutants in the exhaust gases. Fluidized bed burning is thus very desirable and advantageous. However, to bring the fuel loss caused by blown-away unburned particles and consequently bring the particulate pollution down, which is still objectionable in urban areas, as earlier mentioned, and additional step must be taken to reduce the particulate content of the combusted gases before they are allowed to proceed to the heat extraction step. The object of the present invention is to eliminate this additional step and to exhaust combustion products that can be ducted directly through a heat exchanger.

The approach taken in the present invention is. to increase the wall surface area through which air is introduced and to impose alternate pathways to fuel particles in the combustion region so that particles can segregate themselves according to size and be given time to burn without grossly interfering with other burning particles of different physical characteristics. The three most meaningful of these physical characteristics are: (1) particle size; (2) particle material density; and (3) particle shape. As earlier explained, to create a fluidized bed, particles must be prompted to move in a direction opposite to that which an externally applied force incites them to follow, in a given location. Those two opposite forces are the particle weight and the aerodynamic action of the surrounding gas stream. The particle weight is due to the particle mass acted upon by the gravity field. The fuel particles being normally neither magnetically nor electrically charged, the only practical way to generate a force stronger than weight and acting in any preferred chosen direction is to create an artificial gravity field which then gives the particles an artificial weight. This can be easily achieved by means of a centrifugal force generated by the forced gyration of the mixture of gas and particles, around a fixed selected axis, as done in a cyclone separator. At the same time the particle/air mixture gyrates, the air must be caused to move radially inwardly to create an aerodynamic drag directed in opposition to the centrifugal force exerted on the particles. Thus particles are naturally prompted to move radially outwardly and air must be caused to also move radially, but inwardly, at least in part of the combustion region. Because the artificial gravity field is not uniform (weaker near the axis of gyration, stronger farther away from it), and because larger particles have a terminal velocity higher than smaller particles', the particle separation, or segregation, according to size, is rendered easier, or is reinforced, by the fact that larger particles having travelled farther outwardly are subjected to an increasing artificial weight. At this juncture, means for offering different optimum pathways to larger and smaller particles alike must be provided so that their respective "travel" times, or residence times, are adjusted to best match the the amount of time required by the particles to burn completely during that "travel" on their way out to the exhaust.

This is best achieved by the invention preferred embodiment illustrated in FIG. 1. One can observe what happens to two typical particles p' (smaller) and p'' (larger) after emerging from one of nozzles 54 into the combustion region. p'' has reached out farther than p' at the time when they have both stopped moving in a radial direction. The combination of local air flow direction and path of least resistance imposes two different paths to p' and p''. p' is prompted to follow a path shown by phantom line X' and p'' is prompted to follow a path shown by phantom line X''. At a later stage of its combustion, particle p'', which may then have reached the location of particle 101 if for some reasons it has burned faster than it should have and become smaller sooner, may then start on path 102, instead of continuing along the conically helical path it had previously followed and shown by 100'.

This occurs because the fluid mixture is forced to flow from the site where it is introduced to the site where it must exit since air is blown in a general upward direction when the burner is positioned vertically. However, in the process of proceeding from bottom to top, it follows either a direct route close to rotating wall 30 (pathway 102) or a longer indirect route close to rotating wall 28 (pathway 100'). These two basic pathways are concentric and share a long common surface along which some turbulence is created by the shear forces generated by the fluid friction existing between the gas flowing along pathways such as 100' and the gas flowing along pathways such as 102, becuse both gas flows constitute two adjacent stream sheaths following different directions. This turbulence facilitates two vital steps of the burning process: (1) it helps small particles finish burning faster during their transitional travel from the helical pathways into the conical pathways (102); and (2) it acts as a sorting out sieve which helps smaller particles separate from larger particles more easily. Because the radius of gyration R of small particles following the conical pathway becomes smaller as they near the top of the combustion region, the influence of the artificial gravity field diminishes. Near the top, the behavior of the particle/gas mixture (small particles in a mix of hot air and combustion products, also referred to as fluid or fluid mixture) starts resembling that of a conventional fluidized bed burner in its upper region, onto which a vortex motion would have been imposed. Such vortex results from the initial angular momentum given to the fuel/air mixture at the bottom of the combustion region. Therefore, a certain amount of angular acceleration is imparted to the ascending column of fluid as it nears the end of its travel. The resulting effects are complex and difficult to analyze. They also depend greatly upon the local design and shapes given to walls 28 and 30 in the upper region. It must be remembered at this point that the rotating walls have the same angular velocity at all locations. Thus the fluid tends to rotate faster than do the walls near the top. A second turbulence zone is thereby generated at the boundaries between the fluid and these walls. However, any controlled extra turbulence created by this difference in angular velocity between the rotating walls and the fluid can only be beneficial for completing the combustion of small particles still left unburned at that point. The caause of this increase in angular velocity of the fluid is the convergence imposed on the conically shaped fluid flowing sheath which consists of all pathways such as 102. The reason is demonstrated below. If $F_c$ is the centrifugal force exerted on a particle of mass m having a tangential velocity component $V_t$ at a distance R from the axis of gyration, two relationships exist between these variables: (1) $F_c=m(V_t^2/R)$ and (2) $M_t=m\cdot V_t$, where $M_t$ is the tangential component of the particle momentum. If $M_t$ is to remain constant theoritically (C) (momentum conservation law) and for a unit mass, from equation (2), knowing that $V_t=\omega\cdot R$ (where $\omega$ is the angular velocity), one can write that $R=C/\omega$ (3). From equation (1), one can derive the following relationship: $F_c=C^2/R$ (4). As R decreases in the vortex mentioned above, the angular velocity $\omega$ increases proportionally to 1/R and $F_c$ decreases in the same manner. Practically, because of momentum losses due to frictions internally within the vortex and externally with wall 30 and the fluid contained in the helical pathways, $\omega$ and $F_c$ decrease even faster than 1/R. During the last portion of their travel on their way out of the combustion region, $F_c$ may become smaller than the particle weight referred to earlier as F. Also, the drag force exerted on these particles mostly results from the upward velocity of the bulk of the fluid in that location, particularly in region $\mathfrak{R}$ above tip T of wall 30. Journal wall 36 and wall 29 are not porous and the fluid vortex still existing at that level centriguges the few partly unburned particles remaining against the inner surface of these walls. At the top end of wall 36, a conically shaped inverted guard 240 (shown in phantom line) may be used to prevent such particles from proceeding further into exhaust vent pipe 86. To prevent excessive buildups of such particles against wall 36, broomlike sweepers 242, supported by stem 244 anchored on manifold 85 structure, may be used in conjunction with guard 240. The swept particles fall back in the upper portion of the combustion region, where they are then automatically recycled.

The fuel/air mixture injected through nozzles 54 enters the lower portion of the combustion region in the manner shown in FIG. 3. The nozzle exiting mixture is injected at a velocity V' with respect to the nozzle tip. The tangential velocity of the tip is V''. The resulting velocity of the mixture is V. The correct combination of the values of V' and V'' (consequently of angle $\beta$ made by nozzle 54 direction with respect to a radial axis such as Y) insures that V is directed radially outwardly and mostly perpendicularly to the axis of gyration. This requires that the exit velocity of the mixture and rotation speed of the rotating walls be constantly adjusted accordingly, as discussed in the control operation section. This radially oriented mixture jet soon impacts the mass of the fuel/air mixture already gyrating where combustion is taking place. A turbulent zone located as indicated by spot circle 245 is thus created, where particles are ignited and where some segregation of particles by size already takes place. The larger particles proceed, propelled by their artificial weight, toward blades 69. The influence of earth gravity prevents them from moving horizontally and their trajectories are deflected down toward the upper surface of wall 42 (burner axis in a vertical position).

From point 250 outwardly on wall 42 to point 251 located at the bottom end of wall 29, rotating wall 28 has a porous texture which allows air to permeate and pass from its external surface to its internal surface, as illustrated in FIGS. 8 and 9 that depict two different approaches to creating such wall porosity. The approach shown in FIG. 9 is that used in conventional fluidized beds. A large particle 252 is represented approaching wall 28. Particle 252 is larger than the diameter of the end 141 of hole 140. That particle is subjected to the resultant force 253 of its own weight and centrifugal force $F_c$ acting on the particle at that location. The aerodynamic drag 254 is exerted in opposition to the direction of resultant 253. Assuming that 253 is larger than 254, the particle moves closer to wall 28. At some time later, it is either caught by one of the jets such as j and the drag increases suddenly to a value higher than the value of 253 and the particle is pushed back in the direction in which drag 254 is applied. If the particle approaches wall 28 between contiguous jets j, it could theoritically reach wall 28 (and some do), and land between three or four contiguously located holes. If the holes are positioned closely enough, the probability of such an event is very small or even nil. Most likely, such a particle is caught in one of the turbulent zones between jets and thrown back in a direction which probably will cause it to collide with other particles. It is unlikely that a small particle such as 256, smaller than the diameter of end 141 of hole 140, can overcome the velocity of the air exiting from any hole end 141. This could happen only when and if the air flow through rotating wall 28 were stopped, whereas wall 28 is still kept rotating. The combustion system control insures that this cannot occur under normal operating conditions, as discussed in the next section.

The other approach used for creating porosity in wall 28 (and 30) is to construct the wall structure by sintering balls which have the same size (ball 136 of FIG. 8) or have different sizes (balls 138' and 138" of FIG. 9). The sintering process and the results thereby obtained hardly differ. In either wall sintering configuration, the air enters through interstices 136 or 139, travels through wall 28 thickness by means of intersticial passages such as 138 located between contiguously located balls and exits through interstices such as 139' or 139" between balls located near the internal surface of wall 28. The size of the balls, their configurational arrangements and the extent of surface contact between them define the average size of such interstices. The structural strength of the rotating walls depends of course, for a given ball material, upon the extent of the the ball surface contacts. Very strong refractory structures are fabricated in this manner, using a sintering process (gas turbine blades for instance). When a fuel particle such as 258 of FIG. 8 comes near the internal surface of wall 28, it is subjected to three forces: (1) centrifugal force 259; (2) its weight 261; and (3) the aerodynamic drag 262. In this instance, jets such as j of FIG. 9 do not materialize in a manner as easily identifiable. The air thus emerging at the internal surface of the rotating wall forms a turbulent boundary layer which prevents most particles from reaching this surface. The particles pressed by the centrifugal force form another layer against this boundary layer. The pressure in that boundary layer is high enough to force the air so trapped to turbulently escape through the loosely assembled particle layer. A fluidized bed effect is thus also created, but less effective than that which holes help generate. However, it is better suited for situations where the particles are small and/or where the centrifugal gravity field is weak. Both porosity types have an optimum use here.

At this juncture, one must examine more closely the configurational shapes required of walls 28 and 30 and the roles played by each of these two walls. In the case of wall 30, the major role is not to create a fluidized bed, but to: (1) help channel the fluid mixture along one side of the conical pathway; (2) isolate the hot combusted gases and the still burning small particles in it from whatever structure is needed for creating such a channel; and (3) provide and maximize the fluid friction existing between the wall and the fluid mixture in a direction orthogonal to the general direction of the flow of the fluid being so channelled. The totality of rotating wall 30 most likely can be constructed with sintered balls. In the case of wall 28 of FIGS. 1 and 3, the manner in which the particles are driven by resultant forces such as 253 and 260 gives them a direction which may be often far different from the perpendicular to the wall internal surface at that location. The wall may be approached at almost a grazing angle, in which case the wall presence itself influences the particle trajectory, whereby a feedback effect then is generated between the wall orientation and the particle motion (channelling effect). For example this is particularly true in the regions where wall 28 forms the spiraling developable faces of helical pathway 100', such as 263 or 265. In such locations, the particles and wall 28 interact in a manner rather similar to that of wall 30, contrary to what is the case in locations such as 263', and 265' especially. Therefore, wall 28 must be constructed in a mixed fashion, whereby some portions have straight holes and others are made with sintered balls. In practice, all of wall 28 can be sintered, but with additional holes being drilled (or created) in particular areas (263' and 265' for instance). Also, the degree of effectiveness required of the effects of jets j on nearing particles vary from area to area, especially where holes are needed. Spacing the locations of the center lines of these holes can be programmed so that the number of holes per unit area of wall matches the concentration of particles normally being propelled in the direction of a specific location (263' and especially 265'). This jet density or concentration (all holes have the same diameter, though) corresponds to the concentration degree of particles normally arriving toward them. For the range of normal operating conditions and a given design configuration of the burner, the particle concentration is known at all locations from point 250 to point 251 on the internal surface of rotating wall 28, especially in the region that extends from point 250 to point 250' (half-way up to the midsectional plane of the helix first convolution).

The exact shapes and relative positions of rotating walls 28 and 30 determine the relative importance of pathways 100' and 102. These can be optimized for a given fuel and given particles (size, shape and their probability frequency distribution function, for that fuel), and a specific regime of operation of the burner (heat production, average temperature of the combusted gases and particulate pollutant content). Operation conditions deviating widely from those for which the burner is optimally designed may result in unsatisfactory performance of the burner. However, the possibility inherent to the burner concept of changing the rotating walls singularly or as a matched pair to fit the various operational conditions that may be needed, without changing any others of the combustion system parts and/or components, widens considerably the range of operations for which the combustion system of the present invention can be optimally adapted for, and adjusted as the fuel requirements warrant.

Another region inside the burner plays a vital and important role. It is located near the bottom 156 and between blades 69. The main function of blades 69 is to receive the momentum of the air leaving guide vanes 68. A secondary function is to transfer the air momentum and impart it to the rotating wall assembly. A tertiary function is to enhance the friction, at the most critical location, between the fuel/air mixture and the outer rotating wall so that the momentum transfer to this mixture is as effective as possible. Finally, the last function is to generate a highly turbulent zone reached only by the largest particles, in which these large particles are given the optimum opportunity to burn quickly and are thus preventing from lodging in bottoms 266 which are situated on the side of wall 28 opposed to blade 69 leading edges. These form ideal receptacles wherein particles could easily pack. Because the tangential velocity V" at the point where the particles leave nozzle 54 is smaller than the corresponding tangential velocity of a blade 69, the particle/air mixture must be angularly accelerated. Some of this acceleration is provided by the already gyrating mixture mass, but not sufficiently fast to bring the largest particles up to the tangential velocity of blades 69. Large particles approach spaces such as 267 in the direction of arrows f of FIG. 3, which would be unfortunately ideal for compacting particles in those spaces. The aerodynamic forces that exist in the zone where particle 100 is shown starting on its spirally path create the turbulence needed to hamper somewhat this packing tendency. In a more effective manner, this is accomplished by providing a high concentration of holes 140 on the blade walls. Also, thin slots having the cross-section of the holes shown in FIG. 9 can be cut on the leading edges of blades 69, whereby preventing particle build-ups at the bottom of spaces 267. The shear forces caused by the difference existing between blades 69 tangential velocity and the tangential velocity of the mixture in the annular zone located immediately inwardly from bottoms 156 are the aerodynamic mechanism by which blade 69 contours imparts its angular momentum to the particles/air mixture at the time it originates its vortex motion. Region 60 is thus characterized by a high level of turbulence and burning rates. It is also there that the separation of particles by size originates, to be continued all the way to region $\mathcal{R}$ .

The last aspect of the fuel/air mixture handling and behavior is that which is initiated in tube 44 of FIG. 2 and continued until the mixture leaves nozzles 54. Referring to the schematic of FIG. 17, where the fuel storage tank is represented by a small rectangular block identified as FUEL, the fuel is transferred by means known in the art to an air-fuel mixing mechanism, also well known in the art and not part of the claimed present invention. This is done by means of a venturi-type of air injector which fluidizes the fuel particles flow in fuel feed duct 44 which brings the fuel to nozzle 48. The jet stream 46, which at this point contains a high concentration of fuel, is then somewhat diluted in pipe 52 in additional air so that the mixture injected by nozzles 54 is still very rich in fuel. The complement of the dilution of the fuel in air is provided by air introduced by rotating walls 30 and mostly 28. The air used to supply wall 30 through-flow is channelled by duct 80. During their travel from mixer 189 to nozzles 54, the particles are forced to make two 90° turns. The first turn, depicted in FIG. 6 and described earlier corresponds to a mixture flow with high concentration of particles, whereas the second turn corresponds to a mixture having a lower fuel concentration. However, in the latter case, particles must still bend their trajectories appreciably. As seen in FIGS. 1 and 3, a plenum chamber 280 serves as a transitional zone where the mixture velocity is considerably reduced, because of the expansion forced on the flow exiting through the annular area determined by concentric tubes 52 and 80. The mixture flow, where the local velocities have been much reduced, can be guided gradually at the top of plenum chamber 280 by fairings 281, into the entrances of nozzles 54.

The initiation of the particle combustion, when the system begins its operation, is provided by non-solid fuel emerging from injectors 96, located between nozzles 54. This fuel can be liquid and self-igniting in air, or liquid (or gaseous) and ignited by means of high-energy spark plugs, not shown for simplicity sake. Because pipe 52 is fixed and the ends of duct 80 and nozzle 96 supply tubes 94 must rotate with the plenum chamber assembly, rotating slip joints 283 must be provided in the region identified in dotted line in FIG. 2. Such rotating slip joints also allow the slight axial movement required by the minimal vertical motion of the rotating wall assembly. Such rotating joints are state-of-the-art and require no further elaboration. Firstly, the operation of the rotating walls and air flows are started. Secondly, the ignition fuel is injected. Thirdly, when the temperature of the exhaust T detected by the temperature sensor located above bearing 32 has reached a specified level, the introduction of particulate fuel is started. When temperature T reaches a higher specified level, the burner is deemed operating and the combustion of the fuel particles self-sustaining. The ignition fuel flow is then automatically terminated.

To stop the burner operation, both air flows and particulate fuel flow are first decreased gradually down to the combustion self-sustaining operating conditions. The particulate fuel flow is stopped. Finally, the various air flows are also stopped sequentially, the air bearing air flows being stopped last, when N has reached a nil value (walls 28 and 30 no longer rotating).

When the burner is not operating, wall 42 air seals rest against plate 144 (FIG. 10). Prior to starting the combustion system operation, the ignition fuel injection and the air flows for introducing air in the combustion region, compressed air is supplied to air cushions 148 and the rotating wall assembly is slightly lifted. Then compressed air is supplied to the air cushions of bearings 32 and 34. The rotating wall assembly becomes thus suspended and centered by the air pressure in these air cushions. Referring to FIG. 20 which illustrates the influence of the size of the air gaps through which the air cushion compressed air escapes, a small sketch diagrammatically shows how the air flows through these air cushions. Essentially, the air bearing system can be represented by a tube housing two restricting orifices in series. Fixed size orifice 157 is that which is shown also in FIG. 16. Restricting orifice 157' is that which represents the gap area through which the compressed air escapes from the air cushion chamber and which is of course variable by nature, depending upon the radial position assumed by a journaled wall (for example wall 38 of FIG. 5). Assuming that pressure P is regulated and kept constant, pressure P' varies between two extreme values P and P'' (pressure in a volume into which the bearing air is freely discharged, and which can be assumed to be atmospheric pressure). Pressure P' acts on the area of the surface common to the air cushion and the journaled wall. In the bearing configurations adopted in the preferred embodiment of the present invention, six air cushions encircle the journaled wall. Pressure P' can reach a value $P_1'$ close to P when orifice 157' is almost closed (journal off-centered in the direction of that air cushion) or a value $P_2'$ substantially lower than P, but still appreciably larger than P'' practically (journal off-centered in the direction opposite to that of that air cushion). A restoring force $F_b = Ax(P_1' - P_2')$, where A is the effective area onto which the air cushion reacts, is then developed for each side of the air cushion. Because two adjacent air cushions are actually used for each area A, the total force exerted on the journaled wall is $2A(P_1' - P_2')$, for both sides. At this juncture, to simplify matters, the influence of contiguous air cushions can be ignored. Force $2F_b$ thus pushes the journaled wall back to its centered position, for which $P_1' = P_2'$, each and every time that the journaled wall strays off-center. The rotating wall assembly is subjected only to negligible side forces that vary only gradually and thus is unlikely to be prone to wobbling. It behaves very much like a stable top. At this point, the question arises as to whether annular air cushion 148 also should be also divided into segments. This could be done, but it appears that this is not really needed. To simplify this discussion, it is assumed that bearings 32 and 34, because of the large distance separating them, can provide adequate restoring moments. The only appreciable side forces exerted on rotating wall 28 is the impact of the air exiting from guide vane 68 assembly. Another disturbance could be at times caused by particles packing preferentially against one side of wall 28 internal surface. This possibility exists and its effects can be overcome with the use of a vibration detecting system and of a vibration unit that vibrates wall 28 axially whenever the vibration level exceeds a specified level.

Under normal operating conditions, the only possible source of side forces applied onto wall 28 remains the air impacting blades 69. This air is supplied equally all around the annular space formed by blade 69 trailing edges and wall 70 contoured to form an air distribution manifold, shaped to bring air around all guide vanes at the same pressure. The impact forces applied on all blades 69 are thus equal and balance each other. The number of guide vanes and blades may be equal or differ. In the latter case, the numbers of blades and vanes can be selected so that resonating vibration frequencies can be created at the normal rotation speed of wall 28, thereby generating the low amplitude high frequency vibrations which may help prevent the packing of particles phenomenon previously mentioned.

FIGS. 16 and 20 help determine the magnitude of forces $F_b$. Assuming that volumes 110 and 111 of FIG. 16 represent two diametrically opposed air cushions, the intermediate pressure P' in air cushion 110, for example, varies according to the curve of the graph of FIG. 20. If s' is the air gap provided by air cushion 110, the escape area $A_1$ is proportional to s' and the area $A_1$ and $A_2$ (area of the fixed restricting orifice). If for practical reasons, limits are put on the extreme values of ratio $A_2/A_1$ that can be reached ($a_1$ and $a_2$), the value of P' varies almost linearly as a function of $A_2/A_1$, if P and P'' remain constant (region a'-a'', solid line curve). For the practical limits $a_1$ and $a_2$, the air pressure extreme values reached by the air in air cushions are thus $P_1'$ and $P_2'$. The actual exact total force applied on one journaled wall is slightly greater than $2A(P_1'-P_2')$, when six air cushions are used as shown, because of the additional side forces generated by the two contiguous air cushions. To make it simple, these will be ignored.

The particle/fluid mass contained between walls 28, 30 and 42 does not all gyrate at the same speed, as earlier explained. Also, the average rotational speed of that mass is lower than that of the rotating walls and it is likely that no substantial amount of that mass actually ever gyrates faster than the walls, under steady state operating conditions, except locally on a negligible scale or during wall angular decelerations. This gyration speed, however, is important because it creates the artificial gravity field needed and the local turbulence zones required to improve the fuel particle burning process. It seems impractical, if not impossible, to detect, monitor and control this mass average gyrating speed $\Omega$. For that reason, the operational parameter used is the angular velocity N of rotating wall 28. Under steady operating conditions, a known fixed relationship exists between this gyration speed and N: $N=k\Omega$, where k is a factor smaller than unity and determined experimentally for specific typical operating conditions of the burner. Because k can be established and expressed as a function of specified operating conditions, N can be used as a means to detect $\Omega$ and monitor it. N is related to two basic operation parameters: (1) the air mass flow through the guide vanes; and (2) the velocity of this air when it impacts blades 69. Two mechanisms used in cooperation regulate the values of these two parameters at all times: (1) the degree of opening of valve 64; and (2) the deflecting angle imposed on the air flow that is impacting blades 69. The operation of blades 69 is different from that of conventional gas turbines, because the impacting air flow does not pass through the blades. The blades act more like the "turbine buckets" of a Pelton impulse hydraulic turbine, which is very inefficient in the present application, but so practically simple and where efficiency is not a critical element. The energy, under steady state operating conditions, required to keep walls 28 and 30 rotating, is rather small, since very little torque is needed, even during changes in the operation regimes when the angular accelerations need not be high. The largest need for a small torque results from the small friction forces created by the air seals, mostly those mounted on wall 42. If air seals are used on the air bearings 32 and 34, they are located at the ends of these bearings opened to the atmosphere. The air pressure in the air cushions is always higher than the pressure in the combustion region. If air dilution is acceptable, air seals may not even be needed at their ends opening into the combustion region. These seals, when the cylindrical air bearings are centered, exert little pressure on the journaled walls. The torque needed to overcome the friction drag thus created is small. For ease of illustration, the length (or height h) of the guide vanes and of blades 69 is shown to be the same in FIG. 1. Practically, to generate higher air velocities, h should be shorter than illustrated. Also, the air must be offered a way to escape unhindered between blades 69, as water does in the case of the turbine buckets of a Pelton turbine. This can easily be arranged by reducing h and letting the air jets emerging from the openings between the guide vanes impact only the central portion of blades 69 and escape, mostly toward gap 74.

The changes in velocity of the impacting air flow and in angle of attack of blades 69 are achieved by rotating guide vanes 68 as illustrated in FIG. 7. All guide vanes are fixedly mounted on a plurality of axes 135 located between the vane leading edges and the centers of pressure of the vane airfoil profiles in a way such that the vanes are always prompted to "open up" (direction of arrow f in FIG. 7) and thereby lower the velocity of the air leaving them. A torque q is constantly applied on axes 135 (direction of f', opposed to f). This torque action on axes 135 is exerted by means of individual levers actuated by an oscillating continuous ring circling the bottom part of wall 20 and shown schematically by small circle 98. The details of this mechanism are not depicted, being well known in the art. The oscillating ring is connected to an actuator which causes it to rotate only a few degrees, back and forth as required and directed by the control system, around wall 20 axis. This actuating mechanism is also omitted, being state-of-the-art. Assuming that vanes 68 and 68'' shown in solid lines are in an extreme position which maximizes the air impact on blades 69 (maximum velocity v and highest angle of attack $\alpha_m$), and that the same vanes (after having rotated) shown in phantom lines represent the other extreme position for minimum air impact (minimum velocity v' and minimum angle of attack $\alpha_o$), the total angular variation of the vanes is $\alpha=\alpha_m-\alpha_o$. The width of the air jets leaving the space between two adjacent vanes then varies from w to w', with $w'>w$. For an equal incident air velocity $v_o$, it is easily seen that the impulse delivered to blades 69 is maximum when the vanes are in the position represented by vanes 68 and 68'' illustrated in solid lines. By convention, $\alpha$ increases in value from 0 (phantom line vanes) to $\alpha_{max}$ (solid line vanes) as the impulse delivered to blades 69 also increases. Vanes 68 and 68'' rotations are effected around points 0 and 0'' respectively, when actuated by the oscillating ring earlier mentioned.

The air impacting blades 69 must be given a lateral exit, because only a small portion of the air passes through the porous walls of blades 69 (slots and holes). The individual air jets exiting between two adjacent vanes 68 are deflected inside gaps 72 located between two contiguous blades 69. As shown in FIG. 1, the bottoms of these gaps, to a certain extent, are shaped to guide the air flow mostly upward toward annular gap 74 which vents into chamber 76 and from which the air flow can envelope the external surface of rotating porous wall 28.

The detection of wall 28 rotation velocity N is effected by the sensing of the passing by of one or two tabs (160 and 160' of FIG. 15) attached to the free end of journaled wall 38. The length and width of these tabs are large enough to always present a solid surface in front of the detecting area of sensor 162, of diameter d', no matter how large the displacements (radial and axial) of wall 38 are. The detection is arranged also always to occur whenever a tab is located within a distance d of the tip of sensor 162. d is larger than the maximum radial distance that wall 38 is permitted to move, within the limits imposed by air bearing 34. The means for detecting the passing of a tab can be of a magnetic, ultrasonic or even optical nature. For the sake of simplification, it is assumed in the preferred embodiment that tabs 160 and 160' (two tabs are used for reason of symmetry) have permanent magnetic characteristics which excite the coil contained in sensor 162, twice every revolution of wall 28. The signal generated by sensor 162 is then sent to the control system for processing.

Above the top end of journaled wall 36, one or more temperature detectors (not shown in FIG. 1, but schematically in FIG. 17) are mounted on fixed wall 86 for measuring the average temperature of the combusted gases leaving the burner, in a way well known in the art. The signal generated by the detected temperature is sent to the control system for processing. It is assumed that the signal magnitude increases as the temperature also increases. It is also assumed that the magnitude of this signal varies proportionately with the gas average temperature for the sake of convenience. The thermal insulation 35 is used to minimize the heat loss through structural wall 20 which is heated mostly by heat radiated by the external surface of wall 28 which is in direct contact with the contents of the combustion region. Air flowing through the porosity of wall 30 is introduced by means of air duct 80 which flares out into the chamber bounded by wall 30, and is attached to the structure forming air nozzles 54.

Basically, two types of air are required to operate the burner: (1) high pressure air for the air bearings and the air/fuel mixer; and (2) low pressure air for the combustion region. Both types are supplied by a blower which delivers air at a pressure high enough for direct use in the combustion region. The air for the air bearings and the air/fuel mixer is further compressed to be delivered at a constant substantially higher pressure. The high pressure air flow is only a small fraction of the total air mass flow used in the combustion system, especially if sliding air seals are used on the air bearings 32 and 34. The remaining low pressure air flow is subdivided into three separate air flows: (1) air flow channelled to the guide vanes (major air flow contribution to the burner through porous wall 28); (2) air flow channelled to pipe 52 for delivering the fuel particles directly into the combustion region; and (3) air flow channelled by duct 80 to cool and permeate wall 30. A discussion of these three low pressure air flows is now warranted, not by order of magnitude, but in the order in which air comes into contact with the fuel particles. The mixing and metering of the fuel by means of air injection and the transport of this highly concentrated particles fuidized flow was briefly mentioned earlier. It is standard practice state-of-the-art and not part of the present invention, thus needs no further elaboration. The first low pressure air flow of any consequence encountered by the particles happens at nozzle 48 outlet. The first dilution of fuel in air occurs above in mixing chamber 290 (FIG. 2) where the air flow velocity is always maintained high enough to prevent the largest particles from falling back down. This air flow velocity remains high until it reaches plenum chamber 280, where it slows down somewhat and creates some turbulence. Some of the kinetic energy of the fluid flow is transformed into an increase of static pressure which is used further along to generate kinetic energy again to provide velocity V' of the fluid exiting nozzles 54 and propel the particles into the combustion region (FIG. 3). A flexible guard fairing 291, very similar to air seals, prevents large particles from dropping into the air bearing space separating pipe 52 wall from the internal surface of wall 38. This air flow is regulated by valve 191 located below nozzle 48 (FIG. 17) and is monitored by the control system. The total area of all the openings of nozzle 54 tips is smaller than the cross-sectional area of any restriction located on pipe 52, between valve 191 and nozzles 54. This first air mass flow is referred to as $\phi_1$.

The second air mass flow $\phi_2$ is that which is regulated by valve 195 and fed by duct 80 to wall 30. This flow is larger than $\phi_1$, but smaller than $\phi_3$ that is the mass flow which: (1) is accelerated and directed by the guide vanes; (2) impacts blades 69; (3) travels through gap 74; (4) fills the chamber between structure wall 20 and porous rotating wall 28; and then finally (5) passes through wall 28 thickness to provide the major portion of the air needed for the fuel burning, inside the combustion region. The solid fuel is then combusted by the sum $\phi_1+\phi_2+\phi_3=\phi$ air mass flow, all other miscellaneous air flows being of negligible magnitudes. This air mass flow $\phi$ and the fuel mass flow injected in the burner per unit of time are the two significant operational parameters which determine Q (rate of heat production) and T (average temperature of the exhaust gases).

Air mass flow $\phi_3$ and the fluid residing in pathways 100' at any given time are somewhat forced, in different ways, to either accelerate upward faster or be slowed down by the effect of the developable sides such as 78 (FIG. 1) of the conical helix on surrounding fluids. Depending upon the direction of the helix pitch and the direction of gyration, this effect helps the flows in the direction they are normally prompted to proceed or hampers them. The rotation direction of wall 28 is determined by the shapes and orientations of vanes 68 and blades 69, and is fixed for a given construction. Wall 28 assemblies, however can be fabricated to orient the helix pitch in either direction, clockwise or counter clockwise, the rotation direction still remaining the same in both cases. The influence of this construction variation needs now be analyzed, so does the magnitude of N.

To create a meaningful artificial gravity field, the mean radius R of the lower part of the combustion region 60 (FIG. 1) and N must have values such that about 4 to 6 g's (g—earth) are exerted on the particles. A practical burner size could be that which coresponds to one foot for the value of R. Now N can be established to obtain the gravity field level mentioned. But N is not the rate of gyration of the fluid mass, because of the slippage characterized by k, not known but which can be determined experimentally for each operation regime of a given burner configuration. k probably varies between 0.5 and 0.8, but will be assumed to be unity for now, a correction for it being introduced later. A practical formula relating N (rpm) to the centrifugal force $F_c$ exerted on a mass M of weight W at a distance R (ft) is $(W\pi^2N^2R)/(900\ g)$. The gravity field Γ expressed in g's is $F_c/W$ or $3.4\times10^{-4}\times R\times N^2$. As an indication of the practical meaning of this formula and its use here, a small mass located on top of the tire of a car travelling at 55 mph is about 30 g's (N=950 rpm). Because a maximum of 6 g's are needed in the present application, the value of N required is only 425 rpm, which corresponds to a speed of 25 mph for the same car used as a figurative model.

Assuming a realistic slippage factor of 0.6 for example, because the influence of N intervenes as its square, means a higher actual value of N of approximately 550 rpm or a corresponding car speed of 33 mph. Obviously, such numbers are quite reasonable and practical. At a distance of six inches from the axis of rotation, the gravity field is still 3 times that of gravity (linear influence of R). The influence of such rotational speeds on the air outside wall 28 and on the fluid inside the helical pathways is not negligible, though, yet not of major importance. This influence depends greatly on four other design parameters: (1) the helix pitch angle; (2) the angle γ (FIG. 1) indicative of the slant given to wall 28 portions 78; (3) the amount of clearance e' between wall 20 and wall 28, when at their nearest points; and (4) the amount of clearance e'' between wall 30 and wall 28 at their nearest points also. The first and second parameters are related to radii such as $r_o$ given to the curvature of the helix "thread" top and bottom. The discussion above serves to indicate that several approaches are available for optimizing the operation of the burner of the preferred embodiment of the present invention. The direction of wall 28 rotation relative to the direction given to the helix pitch angle can be used for relatively accelerating or decelerating the progression of the air and/or gases both outside and inside wall 28. As earlier mentioned, the concentration of holes in and the degree of porosity of wall 28 is programmed, for a specific configuration of wall 28, to match the local requirements for air passage through wall 28 thickness, which result from the wall 28 design and the direction of rotation it is given (established by the orientation of guide vanes 68 and blades 69).

The last aspect of the burner operation to be discussed, on a microscale, is the dynamic behavior of a particle floating in a gas stream and being burned by some of the surrounding oxygen. Typically, a particle assumed to be spheroidally shaped, is pulled by gravity field $\Gamma_{(g's)}$ outwardly in a direction opposed to that of the gas stream flowing inwardly. This gas flow exerts an aerodynamic force approximated as $D=(K'\cdot\pi\cdot\delta^2\cdot V_p)/4$ (5), if a quasi laminar flow around the particle is assumed, for the average particle size of interest. The effect of Γ is to give an artificial weight $w_p=(\pi\cdot\delta^3\cdot\rho\cdot K''\cdot N^2\cdot R)/6$ (6). In equations (5) and (6), the new parameters are: K'—a constant; K''—another constant; δ—particle mean diameter; ρ—particle material density; $V_p$—gas/particle relative velocity, $V_p$ representing also the radial component of the particle terminal velocity; and R—instantaneous radius of gyration of the particle. If D and $w_p$ are equal in absolute value when $V_p$ is reached, combining equations (5) and (6) yields $V_p=K_o\cdot\rho\cdot\delta\cdot N^2\cdot R$ (7), using the new constant $K_o$, which incorporates K' and K''. The influences of N and R were discussed previously. For the likely laminar flow conditions (in the radial direction) existing for the behavior model used, the particle final radial velocity (or gas radial component of its total velocity) increases proportionately with both ρ (fuel material mean density) and δ (particle average size). The constant $K_o$ varies according to the shape of the average particle. Equation (7) serves to establish the need for determining a manner in which the meaningful physical parameters characterizing the particles can be handled to control the burner operation, for a given type of particulate fuel defined by its physical properties (density and shape). Constant $K_o$ is determined experimentally for each specific type of fuel contemplated for burning in a specific design and configuration of burner. This constant is mostly dependent upon the most representative mean size and shape of the fuel particles.

CONTROL SYSTEM OF THE PREFERRED EMBODIMENT

The schematic diagram shown in FIG. 17 and the summary block diagram of FIG. 18 are combined and elaborated on in more details in FIG. 19, which fully illustrates the typical control system required to operate the rotating wall burner. The overall role of the control system is to match the demands made of the combustion system with its output, taking into account the type of particulate fuel being burned, the specific physical characteristics of the burner design and configuration and the limits imposed on the pollutant content of the exhaust combusted gases. The herein described control system achieves this task by: (1) metering and regulating the fuel mass flow rate $W_f$ delivered into the burner; (2) metering and regulating the three basic air mass flow rates $\phi_1$, $\phi_2$ and $\phi_3$ entering the combustion region; (3) metering and regulating indirectly the ratios between these air mass flow rates; (4) regulating the total air mass flow rate $\phi_t$ delivered to the combustion system; (5) controlling indirectly the sum of the various almost neglible miscellaneous air mass flow rates $\phi_4$ which is the difference between the total air mass flow rate $\phi_t$ and $(\phi_1+\phi_2+\phi_3)$; (6) adjusting the manner by which the fuel particles are introduced in the combustion region; (7) indirectly establishing the mean residence time that an average size and typically shaped particle spends in the combustion region; and (8) adjusting the manner by which particles migrate from one type of pathway (elongated) to the other type (shortened) as they burn and become smaller. The various functions assumed by and the sequential steps taken by the control system for performing the above are identified and discussed in the order that signals are generated, sent, sensed, received and processed so as to obtain: (1) a stable operation of the combustion system under steady-state conditions; (2) output performance characteristics of the combustion system that are equal to those demanded by the combustion system operator; and (3) an automatic adjustment of the value of the performance characteristic which insures the satisfaction of the demands imposed by considerations external to the combustion system, e.g. the maximum production rate of pollutants that is acceptable. The functions of receiving, processing, generating computed signals, comparing and sending signals to the various regulating components of the combustion system are performed by a Central Processing Unit (CPU) which incorporates: (1) a computer; (2) an input port assembly for receiving signals; (3) an output port assembly for sending signals; (4) an access console with switches and a keyboard for providing means to the operator for inputing the data and commands needed; and (5) the necessary connections between these various assemblies, internally to the CPU. The computer comprises the programmed logic which guides the control steps to be taken for operating the combustion system, a memory bank for storing the data needed by the computer for calculating the values to be given to the generated signals, and means for displaying the visual information needed by the operator for assessing the combustion system operation. In FIG. 19, the details of and connections between these individual elements are omitted, being well known in the art. Inside the phantom line outline 200, which schematically represents the control system with the exception of mechanical components such as the air flow valving means, five separate blocks are shown: (1) a large block identified as CPU; (2) a smaller block referred to as the air valve monitor; (3) a small block identified as N which represents the part of the control system which regulates the rotating wall angular velocity; (4) a small block identified as (2+3) representing the means for calculating the sum of the air mass flow rates of the secondary and tertiary air sources; and (5) a small block identified as 1/(2+3) representing the means for calculating the ratio between the air mass flow rate of the primary source and the air mass flow rate sum identified above. The small blocks correspond to computing functions and are shown separated and outside the CPU for easy identification, although these functions are performed by the computer. Also, they schematically serve to represent the transducing means required at the interface between mechanical components and computing means, and which are assumed to be incorporated in these small blocks, for illustrative convenience.

An interrupted signal line s-s' connects the CPU to the starter. The CPU is shown connected to the air blower power shaft, indicating that the total air supply is regulated by CPU-issued signals. Two signal lines connect the CPU to the fuel delivery system: (1) one to the fuel metering mechanism; and (2) the other to the valve controlling the air flow used for conveying the particulate fuel. A signal line for monitoring the orientation (angle $\alpha$) of the guiding vanes connects the CPU to the actuating means of the guiding vanes. The CPU is shown receiving the signals inputing the demands $Q_i$, $T_i$ and $Pol_i$ externally, though such signals are accessed directly into the computer console keyboard, so that they can be more readily identified as external input signals. The air valve monitoring system regulates three valving means 64,191 and 195 with individual signal lines. A phantom line (not a signal line) connects the fuel delivery system to the CPU to depict symbolically that the characteristics of the specific fuel being burned are given to the computer for handling, as hereinunder explained. Similarly, phantom lines (not signal lines) are used for representing the indirect connection that exists, within the control system, between the computer output data and the mean residence time ($\tau_d$) of an average particle in the burner. The CPU receives two temperature signals: (1) one representing the average temperature of the exhausting combusted gases; and (2) the other representing the temperature of the air leaving the air blower. The means for detecting and measuring the pollutant content sends its signal to the CPU. Both $F_t$ (total combusted gas mass flow leaving the combustion system per unit of time) and $Q_o$ (heat output rate), typical characteristics of the combustion system output, are shown connected symbolically by phantom lines to the CPU, because the values of these two output parameters are calculated by the computer and thus have an indirect connection with the CPU.

As discussed in an earlier section, the gyration of the air/particle mixture causes the particles and the air to remain in contact for a longer period of time, facilitating thereby their burning process. The higher the rate of gyration, the more difficult it is for particles to migrate, within the combustion region, out of the elongated pathways into the shortened pathways, the end result being a higher combustion effectiveness and a reduction of unburned particulate pollutants present in the exhaust gases. It would seem that, at first glance, N should always be kept as large as possible, and leave it at that. However, because there are penalties in always pushing the value of N as high as possible, N should not be given values higher than is necessary, for any type of fuel. The penalties resulting from higher values of N are: (1) higher wear rates of the sliding seals and/or of the surfaces on which they slide; (2) higher risks of galling, seizing an/or otherwise accelerated local wear; (3) potentially higher side loads applied on the radial air bearings, requiring higher air leakage rates; and (4) higher risks of abrasion of the internal surface of rotating wall 28 by particles being pushed harder outwardly. Thus, a compromise must be continuously maintained by the control system, whereby the operation of the combustion system can be optimized for each type of fuel burned. The resulting trade-offs needed are established experimentally for the various types of fuels being considered. The basic data derived therefrom, which relates and/or limits the various operation parameters, is stored in the computer memory bank in the form of values to apply to the various constant coefficients used in some of the equations presented hereinunder. Such equations constitute the core of the program logic that guides the control system regulating functions.

The control approach preferred is based on the monitoring of the three basic characteristics of the exhausting combusted gases: (1) heat carried out by the exhaust gases ($Q_o$); (2) average temperature of the exhaust gases ($T_o$); and (3) pollutant content of the combusted gases, exhausted per unit of time ($Pol_o$). The values of $T_o$ and $Pol_o$ are sensed, detected and/or measured as applicable by known physical means. The values of $Q_o$ are calculated by the computer as a function of: (1) the particulate fuel flow delivery rate, estimated as a function of the speed of the particulate fuel feeding mechanism; (2) the specific heat content of the type of fuel to be burned; and (3) the total air flow mass delivery rate of the air source (assumed to be a centrifugal blower), estimated as a function of the blower rotational speed. Both the fuel feeding mechanism and the air blower are calibrated in a manner such that their output mass flow rates are known as a function of: (1) the type of particulate fuel; (2) the characteristics of the air entering the blower (temperature and pressure); and (3) their rotational speeds. A rotary type of feeding mechanism can be assumed for the particulate fuel delivery system, such as that depicted in FIG. 25. This basic data is stored in the computer memory bank and the computer automatically adjusts the actual rotational speeds that both rotary systems must adopt in order to deliver the air flow rate and the fuel flow rate which corresponds to the amount of heat production $Q_i$ demanded of the combustion system. If $c_f$ is the specific heat content of the fuel per unit weight, if $W_f$ is the weight of fuel delivered per unit of time, $Q_o$ is then equal to $c_f W_f$. If the total air mass flow rate delivered by the blower is $W_a$ and the (air+combusted gases) has an average specific heat $c_p$ in the temperature range of interest, the average temperature of the exhausting gases is $T_o = t_i + \Delta T$, where $\Delta T$ represents the temperature increase of the (air+combusted gases) mixture caused by the fuel combustion and $t_i$ is the temperature of the air leaving the blower. As a first approximation, the blower inlet and outlet temperatures can be assumed to be equal because the pressure rise in the air blower is small (2 to 3 psi). $\Delta T$ is equal to $Q_o$ divided by $c_p \cdot (W_a + W_f)$ and $t_i + \Delta T = T_o$ is measured. Thus, $Q_o$ can be calculated as:

$$Q_o = c_p 19\ (W_a + W_f) \cdot (T_o - t_i) \qquad \text{(I)}$$

where $W_a$ is the total air weight output of the blower per unit of time. $t_i$ is either known or measured and constantly available. $T_o$ is continuously measured, $c_p$ is a known constant for a given fuel type and $Q_o$ can thus be evaluated continuously by the computer. The computer is programmed to calculate $Q_o$ according to equation (I) above.

The temperature $T_o$ must normally be equal to a temperature $T_i$ demanded of the combustion system, depending on the specific use made of the exhausting gases and $Q_o$ must be equal to $Q_i$. Also, $Pol_o$ must not exceed the value $Pol_i$ that is deemed acceptable for the given chemical characteristics of the fuel burned. The values for the air flow ratios and of $\alpha$ (therefore of N and kN) are preselected by the computer for the type of fuel to be burned, when the combustion system is started, based on the information stored in the computer memory bank, so that $Pol_o \leqq Pol_i$. For the purpose of the following discussion, the nature of the pollutant is limited to the particulate content of the combusted gases, most of it being assumed to be caused by the incomplete burning of some of the fuel particles (which is the most common occurence), and an excess of pollutant content above the upper acceptable limit $Pol_i$ means that the fuel combustion in the burner is not as complete as it should or could be. The three basic parameters $Q_o$, $T_o$ and $Pol_o$ (or $Q_i$, $T_i$ and $Pol_i$) are somewhat interrelated for a given type of fuel. These relationships are established and thus known and are also stored in the computer memory bank. If $Pol_o$ exceeds the limit $Pol_i$, two courses of action are possible, not exclusive of each other. For simplicity sake, each course of action is treated individually and independently below. These two courses of action are: (1) increase the rotational speed of the rotating walls in order to increase the mean particle residence time $\tau_a$ of the average size particle; and (2) increase the ratio $W_a/W_f$ in order to provide more oxygen and to facilitate a more complete combustion. In both instances, the air mass flow rate ratios are automatically adjusted concurrently. The second course of action causes $T_o$ to drop and $T_i$ must then be adjusted by the computer so that the combustion system is able to satisfy the limit set by $Pol_i$ and a corresponding feasibly attainable value $T_i'$, lower than $T_i$, must then be used to adjust the air mass flow rates.

Generally, the value $\delta T = T_o - T_i$ is computed and the corresponding value $\delta Q_o = c_p \cdot (W_a + W_f) \cdot \delta T$ is also computed. The value of $\delta T$ can be either positive or negative, and $\delta Q_o$ can be also equally positive or negative. Thus $W_a + W_f$ can now be computed. Then from $Q_o = c_f W_f$ and also from $\delta Q_o = c_f \delta W_f$, the value $W_f' = W_f + \delta W_f$ is computed, where $W_f'$ is the new value of $W_f$ that is needed to cancel $\delta Q_o$. But, if the correction $\delta W_f$ needed to satisfy $Q_o = Q_i$ and $T_o = T_i$ with $Pol_o \leqq Pol_i$ were to cause $Pol_o$ to exceed $Pol_i$, one of the two courses of action mentioned above must be taken. The second course of action (lowering $T_i$) is examined first, whereby $T_i$ demanded is now a lower $T_i'$. A correction of $W_a$ is then concurrently made so that $Q_o$ is delivered by the combustion system, but at a lower more realistic temperature $T_o'$ where $T_o' < T_o$ and $W_a' > W_a$, where $W_a'$ is the corrected increased total air mass flow that the blower must now deliver. The value $\delta W_a$ of the difference $W_a' - W_a$ is computed and the variation of rotational speed $\delta\omega$ by which the blower must vary its rotational speed $\omega$ is then computed and a corresponding signal is sent by the output port assembly to the blower motor power supply to effect this change in rotational speed. The value of the signal to be sent from the output ports to the fuel feeding mechanism for adjusting its delivery speed by the value $\delta s$ that yields the variation $\delta W_f$ is similarly computed. In all the correction calculations discussed above, linear relationships between $\delta W_f$ and $\delta s$, and between $\delta W_a$ and $\delta\omega$, are assumed, and all $\delta(\ )$ may have positive or negative values, depending upon the "direction" in which the correction is to be made (+or −).

It was earlier explained that an increase of N, everything else remaining the same, causes the combustion process to improve, thereby lowering $Pol_o$. Thus, the first course of action can also be used, so that $T_i$ does not have to be altered. In this instance, the correction $Q_o$ is made by means of $\delta W_f$ also, but without changing $W_a$. A variation $\delta\alpha$ of $\alpha$, which is computed by the computer from stored information to generate an increase $\delta N$ of the rotating wall rotational speed N, is given to the guiding vanes so that rotating wall 28 accelerates its rotation. This increase $\delta N$ slowly brings about a variation $k \cdot \delta N$ of the gas mixture gyrating rate, which is known to lower $Pol_o$ by an amount $\delta Pol_o$ by which $Pol_o$ was exceeded. As earlier mentioned, according to the amount of correction $\delta Pol_o$ needed, either course of action can preferentially be used, or both simultaneously. The selection of the course of action made by the computer depends upon: (1) the magnitude of $\delta Pol_o$ needed, (2) the type of fuel being burned, (3) whether it appears that one course of action alone will be sufficient, (4) which course of action promises to be most effective, and (5) how close the steady-state operating conditions are already to the predetermined upper limits of the parameter that happens to be of most critical significance at that time. Normally, the operator can override the computer choice of course of action by adjusting $T_i$ and inputing a lower value $T_i'$, which is what the second course of action causes to occur automatically.

Concurrently with either course of action taken (or with both as the case may be), for all operating conditions, before the values of $W_f$ or $W_a$ are adjusted as discussed above, another control step is constantly and continuously taken, and in effect. It is predicated on the fact that the ratios by which a given total air flow $\phi_t$ (or total air mass flow rate $W_a$) is divided into primary, secondary and tertiary air mass flow rates, affect the combustion process and its effectiveness. These various air mass flow rates are defined and related as follows:

$\phi_1$—air mass flow rate of the primary air source, or primary air, giving its momentum to outer rotating wall 28 and entering the combustion region through wall 28;

$\phi_2$—air flow rate of the secondary air source, or secondary air, used for introducing the fuel in the burner;

$\phi_3$—air mass flow rate of the tertiary air source, or tertiary air, entering the burner through inner rotating wall 30;

$\phi_4$—total of the miscellaneous air mass flow rates consisting of $\phi_4'$ and $\phi_4''$, where: (1) $\phi_4''$ is the total of the mass flow rates of the pressurized air used by the three air bearings, and (2) $\phi_4''$ is the air mass flow rate needed for conveying the fuel from the feed mechanism to the secondary air duct.

For the purpose of the following discussion, it is assumed that: (1)

$$\phi_4' = H' \cdot N \quad \text{(II)}$$

where H' is a proportionality constant; and (2)

$$\phi_4'' = H'' \cdot W_f \quad \text{(III)}$$

where H" is another proportionality constant. For each set of values of N and $Wf$, the values of $\phi_4'$ and $\phi_4''$ are thus established by the computer which generates the signals for the valving means regulating these two air flows. $\phi_t$ (or $W_a$) is established by the computer as earlier explained. Thus:

$$\phi_1 + \phi_2 + \phi_3 = \phi_t - (H' \cdot N + H'' \cdot W_f) \quad \text{(IV)}$$

For nominal operating conditions and an average type of fuel, the various valving means are nominally adjusted for dividing these air flows according to the mass flow rates expressed below as percentages of the total air flow $\phi_t$, given as examples:

$\phi_1$—50% (total variation range: 40% to 60%)
$\phi_2$—20% (total variation range: 15% to 25%)
$\phi_3$—15% (total variation range: 10% to 20%)
$\phi_4'$—10% (fixed by N, not used directly for control)
$\phi_4''$—5% (fixed by $W_f$, not used directly for control)

Nominally, the three air flows used for affecting the combustion represent at least 85% of the total air flow delivered by the blower and the air mass flow rate ratios between them are allowed to vary appreciably, as permitted and directed by the computer logic, as required. As an example, the most meaningful values of the air mass flow rate ratios are tabulated below:

$\phi_1/(\phi_2+\phi_3)$=nominally 50/35 (variation range: 40/45 to 60/25),
$\phi_2/\phi_1$=nominally 20/50 (variation range: 15/60 to 25/40),
$\phi_1/\phi_3$=nominally 50/15 (variation range: 60/10 to 40/20), with $\phi_4$ being kept constant at 15% of $\phi_t$. The valving means regulating the five air mass flow rates are adjusted to maintain a constant pressure drop across a metering orifice, the effective area of which is directly proportional to the air mass flow rate to be set. Therefore, the variations in value of the three air mass flow rate ratios above are basically the ratios of the areas of these metering orifices of the corresponding valving means. The magnitudes of the signals generated by the computer for regulating the air mass flow rate ratios thus are proportional to both the air mass flow rates and the opening areas of their respective valving means.

It is assumed that the combustion generally improves when: (1) $\phi_1/(\phi_2+\phi_3)$ increases, and (2) $\phi_1/\phi_3$ decreases. The dependency on $\phi_2/\phi_1$ varies with N and cannot be generally stated so unequivocally. As an example and to keep the following simple, in the block diagram of FIG. 19, only $\phi_1/(\phi_2+\phi_3)$ is shown as being a ratio of interest for control purpose. Although the values for that ratio are generated within the computer, for the sake of clarity and understanding, the signal lines shown indicate that this ratio results from the action of valving means, which is indirectly correct. The ratio $\phi_1/(\phi_2+\phi_3)$ is referred to as $r_{1,23}$ and its influence on $Pol_o$ varies generally as: $\delta Pol_o = K_{1,23} \cdot \delta r_{1,23}$ (V), where $K_{1,23}$ is a constant, for a given set of nominal operating conditions of the combustion system. Because two courses of action are possible and can be used for varying $Pol_o$, equation (V) is only one of a set of three similar equations, the other equations being:

$$\delta Pol_{o(N)} = K_1',\mathbf{23} \cdot \delta r_{1,23(N)} \quad \text{(V')}$$

$$\delta Pol_{o(Wa)} = K_1'',\mathbf{23} \cdot \delta r_{1,23(Wa)} \quad \text{(V'')}$$

which correspond to the instances where the gyrating rate of the gas mixture is kept constant (equation V', variable $W_a$) and where $W_a$ is kept constant (equation V", variable N). $K_{1,23}$, $K_1'$,23 and $K_1''$,23 true proportionality constants and are determined experimentally for each type of fuel, and stored in the computer memory bank for access by the computer control program, as applicable and needed. Equation V is used for calculating $Pol_o$ whenever both N and $W_a$ are kept constant, when $r_{1,23}$ is being adjusted. The combustion system is always started in a manner such that the nominal values of the three air mass flow rates, and their ratios, are automatically obtained. If the resulting values of $Q_o$, $T_o$ and $Pol_o$ meet the demanded values $Q_i$, $T_i$ and $Pol_i$, the combustion system then uses these nominal values of the air mass flow rate ratios. However, if as earlier described, $Pol_o$ exceeds $Pol_i$ and corrections in the values of N and/or of $T_i$ appear required to bring $Pol_o$ down by $\delta Pol_o$, the first step taken by the computer is to determine whether the value $\delta Pol_o$ yielded by equation (V) is large enough to bring $Pol_o$ down to $Pol_i$, for the maximum variation $\delta r_{1,23}$ between its nominal value of 50/35 and its extreme possible upper value of 60/25. For fuels of well identified and known types, for which good experimental data exist and that has been stored in the computer memory bank, the range of variation available for $r_{1,23}$ is usually enough for correcting $Pol_o$, without having recourse to either of the two courses of action open. Small differences in fuel characteristics common between fuel batches of a given type of fuel can be accommodated that way. However, such is not the case when the type of fuel is new and its characteristics have only been estimated, and which are only assumed to be similar to those of another well identified and known fuel type for which data is already stored in the computer memory bank. In which case, more than the adjustment of the air mass flow rate ratio may be needed to keep $Pol_9$ at or below $Pol_i$. Then either one or both of the two courses of action are selected as the means for limiting $Pol_o$, as earlier mentioned. The adjustments of the values of N and/or $W_a$ are carried out for values of $r_{1,23}$'s being maintained at or close to their nominal values. Thus, when small differences between batches of the same type of fuel require a small adjustment of the combustion system operating conditions, this small adjustment can be routinely performed by controlling $r_{1,23}$ only, the values of N and $W_a$ remaining the same.

Another aspect of the control system should be discussed now. Because N is not only function of $\alpha$, but also of $\phi_1$, everything else being constant, a variation of $\phi_1/(\phi_2+\phi_3)$, with a constant value of $\phi_t$ being maintained, means that the amount of momentum delivered by $\phi_1$ changes with $r_{1,23}$. Therefore, within the computer, a correction of $\alpha$ must be brought about to insure that the value of N remains constant when $R_{1,23}$ is being adjusted. The relationship $\delta\alpha = C_{(\alpha,N)} \cdot \delta r_{1,23}$ (VI) is used to effect the required adjustment $\delta\alpha$ of $\delta$, when $r_{1,23}$ is corrected by the amount $\delta r_{1,23}$. $C_{(\alpha,N)}$ is a proportionality coefficient, determined experimentally, which is function of both $\alpha$ and N (and indirectly of $\phi_1$). If one other air mass flow rate ratio is used to adjust $Pol_o$, another relationship similar to equation (VI) is also used to effect the adjustment of $\alpha$ needed for cancelling the effect of the variation of that air mass flow rate ratio on wall 28 rotational speed. The cefficient $C'(\alpha,N)$ of this other relationship is different from $C_{(\alpha,N)}$ and also obtained experimentally and stored in the computer memory bank.

The total combusted gas mass flow $F_t$ is equal to $\phi_t + W_f$, except for the air leakage losses out of the air bearings, which are negligible if good air seals are used. If a heat exchanger is used to preheat the flow leaving the air blower, the gas flow $F_t$ is channelled to heat exchanger 206 by a connection represented in phantom line in FIG. 19. This heat exchange takes place after the gas flow $F_t$ has already transferred most of its heat content ($Q_o$) to the means used for extracting heat out of the combustion system exhaust gases, omitted in FIG. 19 as being well known in the art. If the air blower output flow if preheated, the air flow $\phi_4$ bypass heat exchanger 206 to be delivered directly to compressor 187 inlet. Compressor 187 output air flow $\phi_4$ is delivered at a pressure regulated by pressure regulator 170 controlled by the computer so that equation (II) is constantly satisfied. It is assumed that the air flow through the air bearings corresponds to an air flow through a nozzle controls the air flow through that nozzle. As established by equation II ($\phi_4'$ proportional to N), the reguated pressure is thus caused to vary as $N^2$. Pressure regulator 170 is connected to the CPU by interrupted signal line h-h. The air flow $\phi_4''$ needed for conveying the particulate fuel is thus also delivered at a pressure vaying as $N^2$. A pressure regulating valve connected to the CPU brings that pressure level down to values such that equation (III) is also constantly satisfied.

In the block diagram of FIG. 19, the combustion system is represented twice: (1) by the phantom line outline 205, and (2) by the solid line schematic 205'. Also, for ease of understanding, air bearings $B_1$, $B_2$ and $B_3$ are called out twice and are connected as shown at the bottom left corner of the block diagram. Within outline 205 boundaries, other systems and components are also included and represented schematically because they are either mounted on the burner or considered part of it. These are: (1) the starting system, (2) the valving means of the three main air flows, and (3) the block identified as $\tau_a$, which represents an operating parameter, not a component, of vital significance for the combustion process. Because $\tau_a$ is neither measured nor computed, but represents the only expression of the end results of direct control steps and functions, it is called out similarly to a system output parameter. It is shown tied to the burner externally, but placed inside the boundary line 205. Because a variation $\Delta N$ of the rotational speed N of wall 28 is not immediately transformed into a variation $K \cdot \Delta N$ of the gas mixture gyrating rate kN, a considerable time lag is always present in the response of the combustion process to the first course of action taken for adjusting $Pol_o$. The response to the second course of action (increase of $W_a/W_f$) is much more rapid, but less desirable. Of interest, the response time of the first course of action is appreciably longer than $\tau_a$ and not related to it directly. If a heat exchanger were used for extracting $Q_o$ out of the exhaust gases, it would be connected at the dot called out as H.E..

The combustion system is started by switching the CPU on. The air blower and the compressor first start operating. When they have reached the idle regime (self sustaining operating conditions), the starter operation is initiated by the computer. It opens valve 204 and the starting fuel from tank 202 is injected in the combustion region and ignited. Fuel particles are then delivered by the secondary air flow. Ignition of the particulate fuel then takes place. The ignition is detected by $T_o$ rising above a critical value. Both $W_f$ and $W_a$ are slowly increased to the point where the starting fuel can be shut off. Finally, $Q_i$ and $T_i$ are reached. The control system then starts regulating $Q_o$, $T_o$ and/or $Pol_o$ as earlier discussed. To stop the combustion system, fuel delivery is first stopped, then the air blower and compressor outputs are slowly cut down. The air pressure to the air bearings is cut off last, when the rotating walls have stopped and N is nil.

DESCRIPTION OF THE ALTERNATE EMBODIMENT

Figure 21:
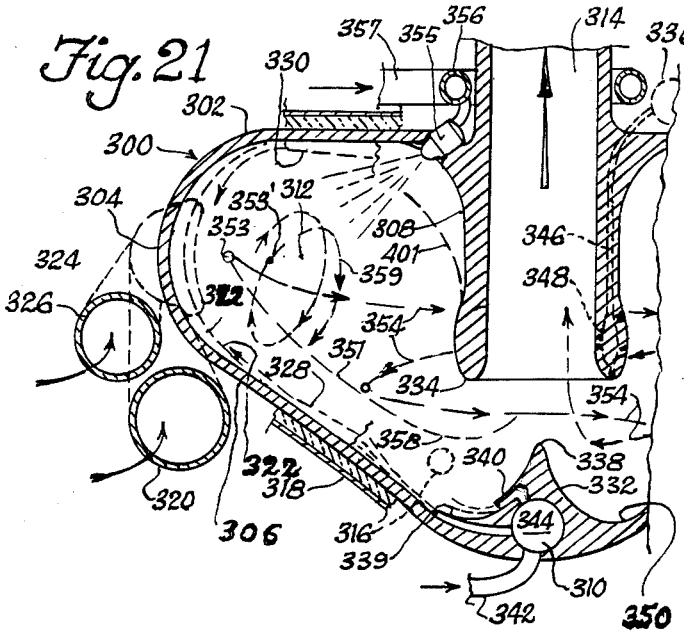
FIG. 21 is a partial midsectional elevation view of an alternate embodiment of the combustion system of the present invntion, taken along section line 21—21 of FIG. 22.
Figure 22:
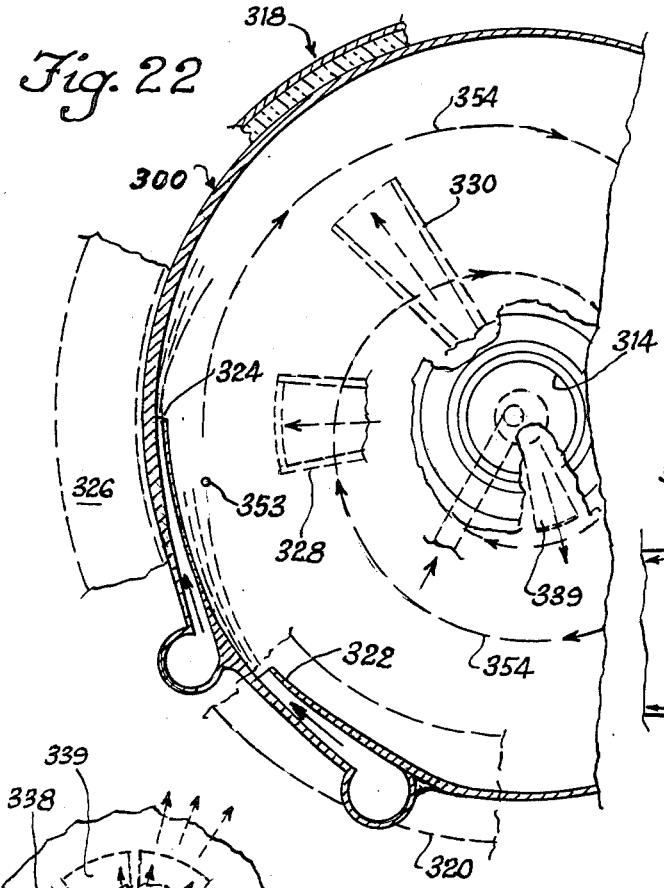
FIG. 22 is a partial plan sectional view taken along section line 22—22 of FIG. 21.
Figure 23:
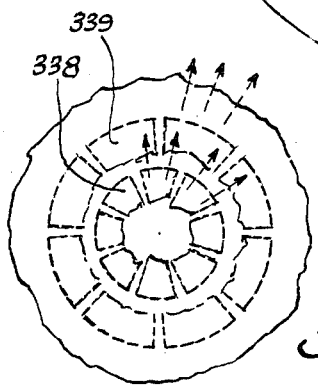
FIG. 23 is a plan view of the arrangement of typically positioned rows and arrays of cooling air nozzles.
Figure 24:
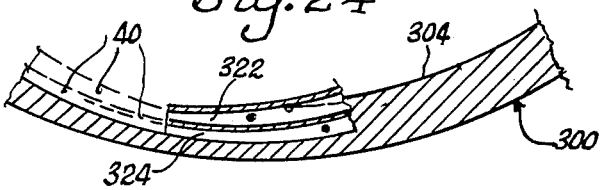
FIG. 24 is an partial sectional view of an alternate positional arrangement of the nozzles introducing the primary and the secondary air flows.

Referring to FIGS. 21 through 24, in which an alternate embodiment in accordance with the present invention is described, a structural shell 300 consisting of five connected walls 302, 304, 306, 308 and 310 envelops and contains the space 312 in which the particulate fuel burns in air and which forms the combustion region. The combusted gases resulting from burning fuel are guided out of the combustion region toward exhaust duct 314 by means of specially shaped channel 316. Structural shell 300 wall assembly forms a surface of revolution around the axis of circular duct 314, and which constitutes the general axis of symmetry (or of revolution) of the shell envelope. The structural shell walls may be insulated thermally by insulating layer 318 wrapped around the shell external surface for preventing heat losses. The particulate fuel is supplied already dispersed in part of the air supply at low pressure (seconday air) by a toroidal air distribution manifold 320 which feeds a plurality of injecting nozzles 322 equally spaced and located on the internal surface of contoured equatorial wall 304 which join flat wall 302 to conically shaped wall 306. Nozzle 322 exit sections are elongated and narrow so as to cover the length of the elevational contour of wall 304. A second set of similar type of nozzles, also with elongated and narrow exit sections, but to an extent lesser than that of nozzles 322, supply primary air at a substantially higher pressure. Nozzles 324 are fed by toroidal air distribution manifold 326 and are also equally spaced around the equatorial belt formed by wall 304. Nozzles 322 and 324 may be distributed in a staggered manner as shown in FIG. 22 or positioned on top of one another as shown in FIG. 24. The circumferential relative positioning of nozzles 322 and 324 is fixed for a given design of the structural shell, but may vary between designs, each being constructed to optimally suit the particular mode of operation desired and/or the specific type of fuel to be burned. The typical positionings illustrated in FIGS. 22 and 24 represent the extreme variations conceivable and any amount of distance between the nozzle air exit section circumferential locations can be accommodated to match any specific design requirements. Nozzles 324 exhaust primary air at high subsonic air velocities tangentially to the internal surface of wall 304 and flush with it. Nozzles 322 exhaust secondary air and the dispersed fuel therein also tangentially to the internal surface of wall 304, but flush with the primary air jets exhausting from nozzles 324, especially when nozzles 322 and 324 are relatively positioned as shown in FIG. 24, so that the primary air forms a sheath of higher velocity air between wall 304 and the secondary air+fuel jets exiting out of nozzles 322. The purpose of such relative positioning of the two types of nozzles is to prevent moving fuel particles from contacting the internal surface of wall 304 in an abrasive way.

Additional air (tertiary) is also introduced tangentially to the other walls 302 and 306 of the shell to cool and protect their internal surfaces, and generally isolate them from the hot gases and burning particles in the combustion region. Nozzles such as 328 and 330 (shown typically and in phantom lines in FIGS. 21 and 22), which distribute this tertiary air at a moderate pressure (higher than that of the secondary air and lower than that of the primary air), also inject the air to form a sheath of cool air and thus have elongated narrow exit sections. They are positioned in a substantially radial direction, but in a manner to either increase or decrease the angular momentum of the gyrating mixture inside shell 300, depending upon the exact orientation given to these nozzles in accordance with the specific desgn requirements dictated by the type of fuel and/or the mode of operation needed to reach an optimal burner performance. Nozzles 328 and 330 are also positioned relatively to the contiguously located nozzles to form rows and arrays such as shown in FIG. 23, whereby the nozzle air jet exits in a manner such that the air jet gap created by two contiguous nozzles positioned in the row further out radially is covered by cool air, so that the air jet coming out of each nozzle is only required to cover a small portion of the total 360° angular coverage needed for the whole wall. The internal surfaces of wall 308 and 332 are also covered by arrays of rows of such nozzles for thermal and anti-abrasion protection. The air required for these nozzles is referred to as supplemental air. Wall 332 forms the internal contour of channel 316 in cooperation with the specially contoured shapes of the tip 334 of the structure inside wall 308 and forming the lower part of the exhaust duct 314. Nozzles 328 and 330 are supplied by manifolds such as 336 (partially shown in phantom lines in FIG. 21), and are arranged to insure that their exiting tertiary air jets cover the totality of the internal surface of walls 302 and 306. The nozzles injecting the supplemental air also cover walls 308 and 332 with such air jets over the totality of their areas. Direct contact between the mixture of hot gas+burning particles and these walls is thus always avoided. The only thermal exposure of the walls is through radiation from the heat generated in the combustion region, the effects of which are mitigated by the cooling action of the tertiary and supplemental air jet flows. The very ends of the tips 334 and 338 of the structures suporting walls 308 and 332 respectively can be made of refractory materials and/or sintered materials cooled by cold air flow sweating as described and discused earlier in a previous section. The cooling air for nozzles such as 340 (supplemental air) is supplied by duct 342 connected to distribution chamber 344 located inside the structure supporting walls 310 and 332. The supplemental cooling air for wall 308 and duct 314 internal surface is supplied by ducts such as 346 supplying a distribution chamber 348, also located within the structure protruding inside shell 300 and which supports walls 308 and the internal wall of duct 314, and partially shown in phantom lines.

Nozzles such as 340, which direct their air jets in a direction generally opposed to that of the exhausting combusted gases, play the additional role of preventing unburned particles from gathering at the bottom of the annular depression 350 formed by the curvature of the bottom of channel 316. Other nozzles such as 340 may be located higher up on wall 332, but which have their exiting air jets flowing in the direction followed by the combusted gases, for protecting tip 338, if it is not made of refractory material. The same applies to the internal surface of duct 314 immediately above the annular ring formed by the locus of tips 334, whereby the cooling air is injected tangentially to the wall, but in the direction of the flow of the combusted gases. Nozzles 339, also supplied in suplemental air by chamber 344, all direct their jet air flows in a direction opposite to that of the combusted gases where they are still gyrating, so as to provide fresh air for the ultimate burning of the few last particles remaining partially unburned. All particles are burned when the combusted gases reach the circle made by tip 334 locus and finally enter the exhaust duct proper.

An adjunct combustion starting system consists of a plurality of injectors 355 which direct their fuel jets toward the quasitorodoidally shaped space 312 (combustion region) where most of the particulate fuel burns. The starting fuel may be of a self igniting nature or be ignited by high energy spark plugs (not shown) as is well known in the art. The starting fuel is supplied by a feeding manifold 356 connected to pipe 357 part of the fuel supply source, not shown here. First, air and particulate fuel are introduced, then the ignition starting fuel is injected and ignited, finally the fuel particles are heated and their combustion is initiated. As the supply air flow rates are increased, concurrently with the delivery rate of the particulate fuel, a steady state operation of the burner is reached. At that time, a fuel particle such as 353, which has just been ignited on it outer surface, is prompted to follow a path such as that partially represented by phantom line 354 and which eventually ends up in duct 314. As depicted in FIGS. 21 and 22, such a line forms a "converging" helix in FIG. 21 and a spiral in FIG. 22. The envelope (or locii surface) of curves such as 354 theoretically generated by any and all particles located on the circle formed by particles 353, if allowed to remain gyrating undisturbed in a plane perpendicular to the axis of symmetry of shell 300, is illustrated in the plane of FIG. 21 by phantom line 358. Actually, all particles such as 353 do not follow exactly such pathways, but generally the particles follow a plurality of pathways located on the surfaces of such envelopes as just described. Such surface envelopes can be visualized as constituting concentric sheaths enveloping each other and arranged like onion layers. Because of the local aerodynamic forces acting on the particles and caused by locally induced turbulent conditions, and the centrifugal forces applied onto these particles, in actuality, a fast burning particle is prompted to migrate from an outwardly located gaseous sheath into a more inwardly positioned gaseous sheath. Depending upon the relative strength and orientation of the tertiary air jets formed by nozzles 328 and 330, it is conceivable that a particle path could form on a quasi-toroidal surface wrapped around curve 354 which would then constitutes the minor centerline of a quasi-torus ("quasi" because the minor circular centerline of the subject "torus" is not a circle, but a converging helix), as illustrated by phantom line curve 359. The length of time that such a particle would spend in the combustion region by following such a theoritical pathway would be considerably augmented, thereby guaranteeing the assured complete combustion of that particle even before it has reached the entrance of channel 316. The assured generation of such pathways would require a very specific design of shell 300, specific arrangement of the positioning and exact performance characteristics of all nozzles for one set of operating conditions of the burner, which is beyond the scope of the present invention, but potentially achievable.

Figure 25:
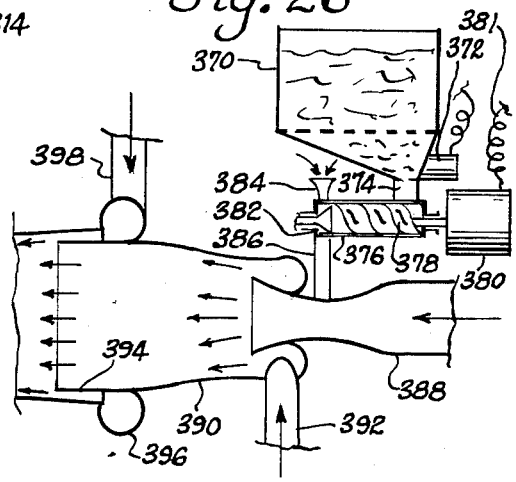
FIG. 25 is a sectional elevational view of a diagrammatical illusration of the mechanism delivering the particulate fuel into the sum total flow of the secondary air.

Referring now to FIG. 25, in which the particulate fuel metering and delivery system is illustrated in a diagrammatical fashion, the fuel is stored and contained in a hopper 370 equipped with a vibrator 372 to loosen the particles and facilitate their flow down chute 374 into a cylinder 376 in which a mechnical helical feeder 378 rotates and is driven by motor 380. Driving motor 380 receives its command signal specifying its rotational speed, therefore the delivery rate of the fuel, by means of signal line 381. The fuel particles are then conveyed into chamber 382 vented to an air inlet 384 and connected to feed tube 386 connected to the throat of a first Venturi tube 388 which discharges into the throat of a second Venturi tube 390 supplied in secondary air by duct 392. The particle-concentrated air flow exiting the first Venturi tube mixes with the secondary air to flow into secondary air duct 394. The mixture (referred to as total secondary air flow) is isolated from duct 394 wall internal surface by tangentially injected supplemental air flows introduced by manifolds such as 396 and supplied at moderate pressure by pipe 398. Duct 394 delivers the total secondary air flow to manisfold 320 of FIG. 21 to feed nozzles 322. First Venturi tube 388 is supplied by air at high pressure so that the suction effect generated in chamber 382 creates therein a pressure slightly lower than atmospheric pressure. This suction effect is kept weak enough though to prevent the fuel particles conveying flow in cylinder 376 from being affected.

Figure 26:
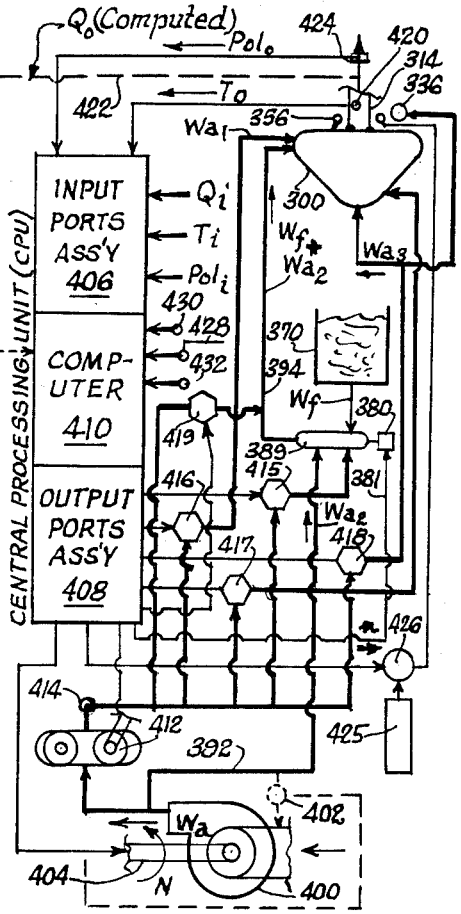
FIG. 26 is a block diagram of one form of control system used to monitor the operation of the combustion system alternate embodiment as applied to the structure illustrated in FIGS. 21 through 25.

FIG. 26 shows a block diagram of the whole combustion system based on the use of the alternate embodiment. An air blower 400 delivers air at a relatively low pressure function of its rotational speed. An optional pressure regulating valve 402, shown in phantom line, may be used to insure that the output pressure delivered corresponds to the value that it should have for the blower rotational speed selected. The driver of shaft 404 receives the command signal specifying the rotational speed of the air blower from a control system that includes input port assembly 406, ouput port assembly 408 and computer 410. The air output flows to the secondary air line 392 connected to the fuel delivery mechanism 389 which includes the two Venturi tubes 388 and 390. Then, the secondary air loaded with the dispersed particles flows through line 394 to the burner represented by the outline of shell 300. The balance of the air flow of the blower output is ducted to the inlet of a compressor 412 equipped with a pressure regulator 414 which maintains the needed fixed delivery pressure. The regulated constant pressure air delivered by the compressor is channelled to five separate pressure regulators 415, 416, 417, 418 and 419 which respectively regulate the pressure of the flows to be supplied to: (1) the first Venturi tube inlet; (2) the primary air nozzles; (3) the tertiary air nozzles; (4) the supplemental air nozzles inside shell 300; and (5) the supplemental air nozzles used to protect the wall of the duct delivering the particle-loaded secondary air. Depending on the design and contemplated mode of operation of the burner, as applicable, the supplemental air flows of (4) and (5) above may be combined, in which case only one pressure regulator is needed instead of 418 and 419. Each pressure regulator is shown receiving its command signal from port output assembly 408 and consists of a flow constricting valve actuated by an actuator (not shown) which sets the delivery pressure downstream, in a manner well known in the art. Because all air delivery nozzles have fixed constant exit area and because these pressures are substantially higher than the gas average pressure inside shell 300, a specific air flow rate corresponds to each and every regulated air pressure level. The performance levels desired of the combustion system are inputed by means of the input port assembly and shown as $Q_i$ (heat output rate demanded), $T_i$ (average temperature of the combusted gases) and $Pol_i$ (upper acceptable limit of the combusted gas pollutant content). A sensor 420 measures the average temperature of the combusted gases and sends its signal to input port assembly 406 for processing by computer 410. The heat output rate is computed and not directly sensed, therefore phantom line 422 connecting the combusted gas exhaust flow to computer 410 is used for indicating schematically and symbolically that a value representative of the heat output rate is indirectly tied to the exhausting combusted gases. The pollutant content of the combusted gases is detected by pollutant detecting system 424, not shown in detail, being also of a type well known in the art, and the signal generated thereby is sent to input port assembly 406 for processing by computer 410. The transducers used for transforming the sensed and/or detected values into electric signals representative of the values sensed and/or detected and of a magnitude usable by computer 410 directly are omitted, being also well known in the art. The starting system which automatically initiates, regulates and stops the flow of the ignition fuel is illustrated schematically and consists of a tank 425 (ignition fuel source), an automatic flow regulating shut-off valve 426, which receives its command signals from output assembly 408 as directed by computer 410, delivers the fuel to manifold 356 feeding a plurality of injectors (not shown). An on/off switch 428 connected directly to computer 410, is used for starting or stopping the operation of he combustion system.

BURNER OPERATION OF THE ALTERNATE EMBODIMENT

The basic operation of a fluidized bed is predicted upon solid particles being prompted to move in a direction substantially opposite to that of the surrounding gas flow which thus forces the particles to be suspended, seemingly levitating, in the midst of the gas stream. The process may occur in a laminar gas flow (low Reynolds number) or in a turbulent gas flow (higher Reynolds number). Practically in the present application, because high flow rates are more desirable, the air (or later gas) flow is of a turbulent nature. Because turbulence helps in keeping the surface of the particles constantly exposed to the local gaseous environment, the particle burning process is accelerated by the adjacent presence of fresh oxygen being unceasingly brought into contact with the particle surface. In the alternate embodiment of the present invention, fresh oxygen contained in the injected primary air is incessantly forced to mix turbulently with the secondary air while passing through it and grazing the already ignited surfaces of most particles. The ignition of these particles is initiated, under steady-state operation of the burner, by the heat radiated from the combustion region where the temperatures are the highest. The spontaneous ignition of those particles starts immediately after the particle-loaded secondary air has left the injection nozzles. Both primary and secondary air flows are introduced into shell 300 to form thinly shaped streaming gaseous sheaths so as to offer the maximum exposure area to this radiated heat. Some distance from the injection nozzle exits, the fluid friction between both adjacent air stream sheath (primary and secondary air flows) boundary layers begins. Because the air velocity of the primary flows is appreciably higher than the velocity of the air of the secondary flows, local eddies of very small size are first created in that interaction zone, the eddies grow larger with time and the mixing of the two types of air flows becomes more pronounced. Most of the kinetic energy of the air thus introduced is contained in the primary air flows. Some of it is lost in the formation of these eddies, but most of that kinetic energy is transferred to the total mass of primary air, secondary air and fuel, which then acquires the angular momentum needed for forming the gyrating gaseous mass later rotating within the walls of shell 300. In the process, continuing intrusion of primary air into secondary air takes place, because the total pressure in the primary air stream sheaths is appreciably higher than the total pressure in the secondary air stream sheaths.

The mass flow ratio between particulate fuel and secondary air is such that only a fraction of the oxygen required to burn the particles completely is present in the secondary air flows. The additional air oxygen necessary to complete the combustion is mostly contained in the primary air flows, although some contributions are made later by the tertiary air flows and, to a lesser extent, by the supplemental air flows. The ratios between these exact mass flow rates depend upon the burner design and specific configuration best adapted to the type of fuel to be burned (physical and chemical properties, particle size and size distribution, general shape, etc. . . ). For the purpose of this discussion, a generalized mass flow rate distribution between the four basic air flows entering shell 300 may be assumed to have the following approximate values:

Primary air flow mass rate=one third of the total air flow,

Secondary air flow mass rate=one fourth of the total air flow,

Tertiary air flow mass rate=one fourth of the total air flow,

Supplemental air mass rate=one sixth of the total air flow.

Depending upon the average temperature demanded of the combusted gases, the mass flow ratio between the total of the air flows and the fuel delivery rate is adjusted accordingly. This ratio is usually below the stoichiometric value (ideal theoritical value for which all of the fuel reacts with all of the oxygen), because practically some fuel would never burn and the particulate pollutant content of the exhaust gases would be too high.

According to the flow rate ratio assumptions realistically made above, more than half of the total air flow is contained in the sum of the primary and secondary air flows. The excess air flow needed to insure a complete combustion ending with an oxygen surplus can be assumed to be between one sixth and one third of the total air flow. Thus, only about two thirds of the fuel can be expected theoritically to have burned when the mixing of the primary and secondary airs is completed. The mixture is then forced to flow downwardly and inwardly as it gyrates. Starting at the onset of the mixing of the two types of air flows, until the mixture reaches the entrance of channel 316 (FIG. 21), the unburned particles are subjected to the centrifugal forces caused by their individual masses and the rotational speed of the vortex. In an earlier section, the tangential and rotational velocity values required to generate the eqivalent of a few g's are calculated. For an average gyrating radius of $\frac{3}{4}$ foot for the core of the combustion region, because the value of factor k is one here, the average tangential velocity is about 30 mph or of the order of 50 to 60 ft/sec. Assuming a loss of 50% during the momentum transfer process between the primary air flows and the secondary air flows, and a mass contribution of only one quarter of the total gyrating mass by the primary air, the maximum primary air velocity exiting its injection nozzles must be then $60\times2\times4=500$ ft/sec, if the momentum contribution of the secondary air flows is ignored. Assuming that the static pressure in the combustion region is approximately 18 psia (a few psi above atmospheric pressure), the total pressure at which the primary air needs be delivered is only approximately 18/0.8 or 22 to 23 psia (or 8 to 9 psig). The factor 0.8 includes all the effects of all pressure losses in the nozzles and corresponds to a peak Mach number of the primary air flow at the nozzle exit sections, which are the discharge restricting orifices since only subsonic air flows are needed, of approximately 0.45 to 0.5. The rough evaluations of velocity and pressures derived and quoted above are intended only to show that relatively low pressures and moderate air velocities are needed to produce the artificial gravitational field required to create the conditions needed for generating the fluidized bed effect wanted.

For the purpose of the subjct invention, the potential possibility of generating a toroidal minor vortex wrapped around and within the major vortex just discussed is ignored and the tertiary air flows are assumed to be injected substantially in radially oriented planes. These tertiary air flows: (1) create the additional turbulence needed for facilitating the exposure of the outer surfaces of the still unburned particles to fresh air; (2) provide the physical means for stopping those particles that are centrifugated toward the outer regions of the major vortex and preventing them from contacting shell 300 walls; and (3) cool these walls by soaking some of the radiated heat transferred to the wall internal surfaces. These tertiary air flows, as well as the supplemental air flows, do not play a significant role in the formation and functioning of the fluidized bed. Their main role, and essential at that, is to protect the internal surfaces of shell 300 walls. Therefore, their minor influence on the outer gaseous layers bounding the combustion region can be ignored, as a first approximation, in the following discussion.

Firstly, it is worth mentioning that the overall outline and shape of structural shell 300 can be inverted, whereby wall 302 is conically converging upwardly directly into the opening of exhaust duct 314. Wall 306 could then be flat and the volume of the lower structure bounded by wall 332 could be substantially increased. Secondly, the formation and operation of the fluidized bed would not be substantially affected. Thirdly, the particles would then still follow an helical path wrapped around a generally conically contoured surface, but converging upwardly, assuming that the normal operating attitude of the burner axis of symmetry is still vertical. Therefore, the following discussion applies equally well to either of such extremely configurated basic designs of the burner, that of FIG. 21 and that with an inverted shape. As earlier mentioned, the discharge nozzles of the primary air flows are much more elongated than the discharge nozzles of the secondary air flows. Because of the double-curvature shape thus imposed on the primary air stream sheaths, they halfway "envelope" the secondary air streams. In addition to the air flow mixing action described earlier, the primary air streams can only expand inwardly, because of the constraining action of the internal surface of wall 304. At the same time some primary air penetrates the secondary air, the sum of these two air streams is forced to converge spirally toward core space 312 of the combustion region. The fuel/air mixture constituting the secondary air streams is gradually accelerated in a manner such that the secondary air stream layers closest to the boundary layer next to the primary air stream accelerate faster than the layers of the secondary air stream located closest to the core space 312. A shear force gradient is thus created along the thickness of the secondary air streams, causing more local turbulences and giving a greater degree of freedom to individual particles for moving freely according to the soliciting forces exerted on them: (1) centrifugal force; and (2) aerodynamic drag. The individual centrifugal forces acting on individual particles start segregating the larger particles from the smaller ones as soon as those layers of the secondary air streams (the word stream is used preferentially to depict the air flow which becomes unconstrained when it has left a nozzle) mix with the nearest primary air layers. This segregation process continues progressively as a section of a secondary air stream moves farther away from its nozzle exit, within that section and throughout the section thickness. By the time the sum of the air in a primary stream and in its associated secondary stream (section sum) has acquired roughly the same average velocity throughout that section sum, which constitutes the initial velocity component of the total rotational momentum of the mass contained in that section sum, a semblance of a gradation by size of the particles therein is already achieved. The smallest particles located already preferentially inwardly are easily ignited by the heat radiating from the combustion region, being best exposed thereto. The largest particles, being located then in the outer layers of the combustion region, for example where particle 353 is shown positioned in FIG. 21, are ignited later. However, they are given more time to burn because their paths on the way out through exhaust duct 314 is longer than the paths that smaller particles such as 353', located inwardly from particle 353, must follow. Also, because of the law of conservation of momentum, the inner layers of the vortex have a tendency to spin faster, because they are constantly pushed inwardly by the continuous injection of air injected at a higher total pressure which pushes them into smaller "orbits" and out of the way. Thus, continuously, from combustion region locations between 353 and 312, to locations such as 316, throughout most of the vortex thickness represented by the shortest distance between the internal surface of wall 306 and the external surface of the lower part of wall 306, larger still burning particles are prompted to move radially outwardly by the centrifugal force applied on them in addition to tangentially (around the axis of symmetry) and smaller still burning particles are forced to move radially inwardly because of the generally inwardly directed gas flow which results from the shape of walls 306 and the tertiary air injection.

Therefore, at the moment the primary air and the secondary air streams exiting from two djacent nozzles have partially mixed, the fluidized bed effect is initiated. It continues and becomes more pronounced with time and finally fully effective for the whole combustion region until the transversal plane through location 316 is reached by the combusted gases. From that point on, the combusted gases are then forced to change their general direction by an amount greater than 90°, in the case of the burner configuration shown in FIG. 21. If a few particles then still remain unburned, they are centrifugated toward the supplemental air streams which prevent their contact with walls 332 and annular bottom surface 350, and provide the fresh air needed to complete their combustion. For some types of particulate fuels, difficult to burn, the configuration of FIG. 21 is thought to be preferable to the inverted shell configuration earlier mentioned, on the account of this second centrifugation effect. In conclusion, throughout the combustion region, it easy to visualize why and how small particls migrate inwardly onto shorter pathways, and why and how larger particles migrate otwardly onto longer pathways, which necessarily means longer residence times for larger particles. The shape of the inner contour surface of the combustion region should be such that it facilitates the flow of the combustion region gases on their downward general path. To that effect, phantom line 401 illustrates a possibly more suitable contoured shape for the internal surfaces of walls 302 and 308.

To facilitate a gradual mixing of the primary and secondary air streams, and to avoid disturbing the attachment of the outer boundary layer of the primary air stream to the internal surface of wall 304, only a few sets of adjacently positioned primary and secondary air nozzles should be used, but at least two, diametrically opposed. Otherwise, if too many sets are used, the result could be several sandwiched stream sheaths of primary and secondary airs. The trade off is a more homogeneous and rapid mixing of the two types of air at the cost of a loss of effectiveness in protecting the internal surface of wall 304 from abrasion by the fuel particles. Again, the type of fuel to be burned should guide the designer in the choice of configuration.

CONTROL SYSTEM OF THE ALTERNATE EMBODIMENT

The elements of the control system used for monitoring, regulating and generally controlling the start and the operation of the alternate embodiment of the present invention are described in an earlier section and illustrated in FIG. 26. The control approach described is predicated on the monitoring of the three basic characteristics of the exhausting combusted gases: (1) total heat contained in the combusted gases and exhausting per unit of time ($Q_o$); (2) average temperature of the exhausting combusted gases ($T_o$); and (3) pollutant content of the combusted gases and exhausting per unit of time ($Pol_o$). The values of $T_o$ and $Pol_o$ are sensed, detected and/or measured as applicable by known physical means. The values of $Q_o$ are calculated by a computer as a function of: (1) the particulate fuel flow delivery rate, estimated as a function of the rotational speed of the delivery mechanism; (2) the specific heat content of the type of fuel to be burned; and (3) the total air flow mass delivery rate of the air source (assumed to be a centrifugal blower), estimated as a function of the blower rotational speed. Both the fuel delivery rotary mechanism and the air blower are calibrated in a manner such that their output mass flow rates are known as a function of: (1) the type of particulate fuel; (2) the characteristics of the air entering the blower (temperature and pressure); and (3) their rotational speeds. This basic data is stored in the computer memory bank and the computer automatically adjusts the actual rotational speeds that both rotary systems must adopt in order to deliver the air flow rate and the fuel flow rate which correspond to the amount of heat production $Q_i$ demanded of the combustion system. If $c_f$ is the specific heat content of the fuel per unit weight, if $W_f$ is the weight of fuel delivered per unit of time, $Q_o$ is then equal to $c_f W_f$. If the total air mass flow rate delivered by the blower is $W_a$ and the (air+combusted gases) has an average specific heat $c_p$ in the temperature range of interest, the average temperature of the exhausting gases is $T_o = t_i + \Delta T$, where $\Delta T$ represents the temperature increase of the (air+combusted gases) mixture caused by the fuel combustion and $t_i$ is the temperature of the air leaving the blower. As a first approximation, the blower inlet and outlet temperatures can be assumed to be equal because the pressure rise in the air blower is small (2 to 3 psi). $\Delta T$ is equal to $Q_o$ divided by $c_p \cdot (W_a + W_f)$ and $t_i + \Delta T = T_o$ is measured. Thus, $Q_o$ can be calculated as $Q_o = c_p \cdot (W_a + W_f) \cdot (T_o - t_i)$ [A] $t_i$ is known from the existing atmospheric conditions and $T_o$ is constantly measured, $c_p$ is a known constant for a given fuel type and $Q_o$ can be continuously computed by the computer which is programmed to calculate $Q_o$ according to equation [A].

The temperature $T_o$ must normally be equal to a temperature $T_i$ demanded of the combustion system, depending on the specific use made of the exhausting gases and $Q_o$ must be equal to $Q_i$. Also $Pol_o$ must not exceed the value $Pol_i$ that is deemed acceptable for the given chemical characteristics of the fuel burned. If the nature of the pollutant is limited to the particulate content of the combusted gases, most of it being assumed to be generated by the incomplete burning of some of the fuel particles (which is the most common occurence), and an excess of pollutant content above the upper acceptable limit $Pol_i$ means that the fuel combustion in the burner is not as complete as it should or could be. The three basic parameters $Q_o$, $T_o$ and $Pol_o$ (or $Q_i$, $T_i$ and $Pol_i$) are somewhat interrelated for a given type of fuel. These relationships are established and thus known and are also stored in the computer memory bank. If necessary, $T_i$ is adjusted by the computer so that the combustion system is able to satisfy the limit set by $Pol_i$ and a corresponding feasibly attainable value $T_i'$ is then used to adjust the air mass flow rates. Whether $T_i$ or $T_i'$ is then used, they are referred to as $T_i$, except if and when confusing, the value $\delta T = T_o - T_i$ is computed and the corresponding value $\delta Q_o = c_p \cdot (W_a + W_f) \cdot \delta T$ is also computed. The value of $\delta T$ can be either positive or negative, and $\delta Q_o$ can be also equally positive or negative. Thus $W_a + W_f$ can now be computed. Then from $Q_o = c_f W_f$ and also from $\delta Q_o = c_f \delta W_f$, the value $W_f' \cdot W_f + \delta W_f$ is computed, where $W_f'$ is the new value of $W_f$ that is needed to cancel $\delta Q_o$. However, if the limitation of $T_o$ brought about by the lowering of $T_i$ to $T_i'$ intervenes, a correction of $W_a$ is concurrently made so that $Q_o$ is delivered by the combustion system, but at a lower more realistic temperature $T_o'$ where $T_o' < T_o$ and $W_a' > W_a$, where $W_a'$ is the corrected total air mass flow that the blower must now deliver. The value $\delta W_a$ of the difference $W_a' - W_a$ is computed and the variations of rotational speed $\delta N$ by which the blower must vary its rotational speed N is then computed and a corresponding signal is sent by the output port assembly to the blower motor power supply to effect this change in rotational speed. The value of the signal to be sent by the output ports to the fuel rotary delivery mechanism for adjusting its rotational speed by the value $\delta n$ that yields the variation $\delta W_f$ is similarly computed. In all the correction calculations discussed above, linear relationships between $\delta W_f$ and $\delta n$, and between $\delta W_a$ and $\delta N$, are assumed, and all $\delta(\ )$ may have positive or negative values, depending upon the "direction" in which the correction is to be made (+ or −).

Another step taken concurrently by the control system logic is to insure that the value of $T_o'$ is as close as possible to $T_i$ so that $T_i - T_i' = 0$ and $T_o' = T_o = T_i$, while $Pol_o$ remains equal to or lower than $Pol_i$. It is assumed that only the content in the combusted gases of particulate pollutant can readily be regulated by the control system and that $Pol_o$ values vary as follows:

(1) $Pol_o$ decreases linearly when the air mass flow rate ratio between primary air ($W_{a1}$) and secondary air ($W_{a2}$) increases, and vice versa, within the operating limits of the combustion system, for a given ratio of $(W_{a3} + W_{s1} + W_{s2})/W_a$, where $W_{a3}$, $W_{s1}$ and $W_{s2}$ are the air mass flow rates of the tertiary air, the lower structure supplemental air and of the sum of the upper structure (exhaust duct) supplemental air, of the protection air for the secondary air delivery duct and of the air supply for the first Venturi tube, respectively; and (2) $Pol_o$ decreases linearly when the air mass flow rate ratios between the sum of the tertiary air mass flow rate and of the first mentioned supplemental air mass flow rate, and the total air mass flow rate $W_a$ increases. The degree of dependency between $Pol_o$ variations and the variations of the air mass flow rate ratios defined above is determined experimentally for a given particulate fuel type when burned in a specific burner design and configuration. These dependency relationships, once established from test results, are expressed as $\delta Pol_o = K \cdot \delta r$, where $\delta Pol_o$ is the variation of pollutant content output, $\delta r$ is the corresponding variation of the air mass flow rate ratio, r being referred to as $r_{1,2}$ in case (1) above and $r_{3,t}$ in case (2) above, and K is the linearity coefficient, K being referred to as $K_{1,2}$ for case (1) above and $K_{3,t}$ for case (2) above. The specific values of $K_{1,2}$ and $K_{3,t}$ determined experimentally are stored in the computer memory bank and the governing equations used by the computer program, also stored in the computer memory bank, for controlling the air mass flow ratios are as follows:

Variation of $Pol_o$ at a constant value of $r_{3,t}$:

$$\delta Pol_{o(r3,t)} = K_{1,2} \cdot \delta r_{1,2} \quad [B]$$

Variation of $Pol_o$ at a constant value of $r_{1,2}$:

$$Pol_{o(r1,2)} = K_{3,t} \cdot \delta r_{3,t} \quad [C]$$

$$r_{1,2} = W_{a1}/W_{a2} \quad [D]$$

$$r_{3,t} = (W_{a3} + W_{s1} + W_{s2})/W_a \quad [E]$$

$$W_a = W_{a1} + W_{a2} + W_{a3} + W_{s1} + W_{s2} \quad [F]$$

and $$W_{s2} = W_{s2}' + W_{Vp} + W_s' \quad [G]$$

where:

$W_s'_2$ is the air mass flow rate for the upper structure cooling;

$W_{Vp}$ is the air mass flow rate supplied to the first Venturi tube;

$W_s'$ is the air mass flow rate of the protection air for the delivery system (duct & nozzles) of the particle-loaded secondary air.

The computer program logic is established to adjust $W_{Vp}$ and $W_{s'}$ linearly with $W_f$ by means of regulating the pressure in the delivery pipes of the these air flows. $W_s'_2$ is adjusted automatically as being a fixed proportion of $W_{s1} \cdot W_{a1}/W_{a2}$ is controlled by the computer to have a value equal or as low as possible above a value $(W_{a1}/W_{a2})_{min}$ predetermined experimentally for each type of fuel and that is stored in the computer memory bank so that the fuel is always as highly diluted as possible in the secondary air, in order to minimize the amount of wear of the burner components by abrasion. A lower value of $W_{a1}/W_{a2}$ causes a lower rotational speed of the burning mixture in the combustion region. The results are: (1) lower mechanical wear of the burner internal walls; but (2) a less effective combustion and an ensuing higher production rate of particulate pollutants. Depending upon the nature of the fuel and the given upper limit of $Pol_o$, one now understands why $Pol_o$ decreases when $W_{a1}/W_{a2}$ increases, at the cost of higher rate of mechanical wear of the burner components. To minimize wear of the delivery system of the particle-loaded secondary air, $W_{a2}/W_f$ should be held always at a value as high as possible, at the expense of higher values of $Pol_o$. Finally, $(W_{a1}+W_{a2})/W_a$ should be maintained at its lowest acceptable value so that higher air flow rates are available for $W_{a3}$ and $W_s$, both contributing to lowering the burner wall temperatures and wear rates. These three basic considerations regarding the roles of the various air mass flow rate ratios thus are guiding the two basic operating goals of the control system: (1) keeping the pertinent air mass flow rate ratios at, or closest to, their optimum values, predetermined experimentally to be the values which cause the least amount of wear of the burner walls and keep them at the lowest operating temperature; and (2) adjusting and controlling the values of these air mass flow rate ratios so as to maintain them as close as possible to their optimum values so that $Pol_o$ is nevertheless kept at or under its maximum acceptable upper limit.

As $W_a$, $W_f$, $T_o$ and $Q_o$ are constantly and concurrently adjusted and regulated as earlier mentioned, the ratios $r_{1,2}$ and $r_{3,t}$ are monitored as $Pol_o$ is measured and continuously compared to $Pol_i$. If and when it appears that $T_i$ should be adjusted down to $T_i'$ to lower $Pol_o$ down to the upper limit $Pol_i$, whereas the value of $r_{1,2}$ is still at its minimum limit and the value of $r_{3,t}$ is also still at its maximum limit, before the step of lowering $T_i$ to $T_i'$ is taken by the computer program instructions, the values of $r_{1,2}$ and of $r_{3,t}$ are adjusted according to equations [B] and [C] if it seems that the maximum available variation ranges of $\delta r_{1,2}$ and $\delta r_{3,t}$ can generate a total variation $\delta Pol_o$ large enough to bring $Pol_o$ down to the value $Pol_i$. If not, a lower value $T_i'$ of $T_i$, that will insure that $Pol_o \leqq Pol_i$, is selected for values of $r_{1,2}$ and $r_{3,t}$ that represent the other extreme limits of their possible adjustment ranges, at the expense of a higher rate of wear and higher burner wall temperatures. Once the ratios $r_{1,2}$ and $r_{3,t}$ are determined, the values of the various air delivery pressures are computed so that the corresponding air mass flow rates are automatically delivered, according to the general equation:

$$\phi_n = C_n \cdot A_n \cdot (P_{cn} - P_i)^{\frac{1}{2}} \quad [H]$$

where:

$\phi_n$ is the air mass flow rate of the $n_{th}$ air flow (primary, secondary, tertiary, etc. . . . );

$C_n$ is a constant coefficient representative of and including the influence of the air pipe pressure losses and various discharge coefficients of the $n_{th}$ air flow;

$A_n$ is the total discharge sectional area of all the nozzles injecting the total of the $n_{th}$ air flow;

$P_{cn}$ is the total absolute pressure regulated by the $n_{th}$ air flow valving means; and $P_i$ is the average pressure measured or estimated in the burner chamber (fixed value under normal operating conditions).

Of course, $$\sum_1^n \phi_n = W_a = \text{total air blower output rate.}$$

The values of $W_{Vp}$ and $W_{s'}$ are directly calculated as being proportional to $W_f$. Because the computer logic tends to minimize $W_{a1}/W_{a2}$ and $(W_{a1}+W_{a2})/W_a$, the direct result is to maximize $W_{a2}/W_f$ (or minimize abrasion and/or facilitate the particulate fuel flow downstream of the first Venturi tube).

For some types of fuel and particles characterized by an optimum shape, size and size distribution, the control system can regulate the normal operation of a burner of specific design and configuration so that, under most conditions, the demanded values $Q_i$, $T_i$ and $Pol_i$ can be obtained for values of $r_{1,2}$ and $r_{3,t}$ being between the two extreme values defining their variation ranges. In such instances, the pollutant content of the combustion gases can be lowered below the value $Pol_i$, while $Q_o$ and $T_o$ can be maintained equal to $Q_i$ and $T_i$ respectively. The trade off in such operation mode can then be made by lowering $Pol_i$ to a lower value $Pol_i'$, more enticing from the standpoint of environmental pollution, but at the expense of possibly a shorter lifetime of some burner components. The lifetime shortening is caused by the possible higher rate of abrasion wear and higher operating temperatures of some stressed structural members. In spite of the thermal insulation provided externally to the burner shell, higher temperatures mean higher heat losses and a lowered overall operating thermal efficiency. Some particulate fuels are more abrasive than others which may have similar physical and chemical characteristics. This second order of control trade off is done outside of the control system discussed here. The input data pertaining to such trade-off information is generated experimentally and stored in the computer memory bank. In addition to on/off switch 428, an access 430 to computer 410 is provided to enter such data (FIG. 26), categorize it and store it. Another access 432 to computer 410 allows the operator to instruct compute 410 as to which input data the computer is to use for control during a specific operation run with a specific fuel. The starting of the combustion system is also regulated by computer 410 which is programmed to either let valve 426 remain open for a given amount of time or become closed when temperature $T_o$ indicates that the particulate fuel is fully ignited. The starting fuel injection is initiated when $W_a$ and $W_f$ have both reached values high enough to insure self sustaining operation of the burner without the assistance of the starting fuel. Stopping the burner operation is done by turning switch 428 off, which first causes the particulate fuel delivery to stop. Then after the burner has cooled down to a specified value of $T_o$, air blower and compressor power supplies are shut off.

In summary, the preferred and alternate embodiments of the rotary fluidized bed combustion system permit the burning of particulate fuel in air in a manner such that the particle outer surfaces are constantly and continuously exposed to the oxygen contained in the surrounding gaseous medium. This is achieved by: (1) causing the fuel particles and the surrounding gases to have an unceasing relative motion until the fuel particles burn throughout; (2) generating local relative velocities between the particle surfaces and the surrounding gases, which continuously help remove the combusted gases off the particle surfaces and bring a fresh oxygen supply in contact with the particles surfaces, thereby accelerating the fuel burning process of individual particles; (3) creating balancing forces acting on individual particles that contribute to their separation according to size, before and during their combustion, which results in automatically segregating the fuel particles sizewise within the combustion region along preferential pathways that the particles are then forced to follow; (4) arranging the relative locations of such pathways in a manner such that large particles follow pathways longer than the pathways followed by smaller particles, thereby causing large particles to reside in the combustion region for longer periods of time; (5) facilitating the migration of partially-burned smaller particles from longer pathways onto shorter pathways; (6) supplying oxygen-rich fresh air along the pathways, until the fuel particles are all completely burned; (7) isolating fuel particles from the structural walls containing and enclosing the combustion region; (8) cooling said walls with the air to be admitted in the combustion region; and (9) controlling the air admission in the combustion region so as to minimize the solid pollutant content of the exhausting combusted gases while maximizing the heat output.

It is thought that the rotary fluidized bed combustion system and method of the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or examplary embodiments thereof.

Having thus described my invention, I now claim:

1. A method for burning fuel in the form of solid particles in a rotary fluidized bed combustion system comprising the steps of:

introducing solid fuel in particulate form;

introducing air for burning said fuel;

enclosing by and containing within walls the mixture of air and fuel thus introduced in a combustion region where fuel and air chemically interact (burning process) in a fluidized bed generated by the manner in which the air and the fuel are introduced in the combustion region;

generating an artificial gravity field substantially stronger than the earth gravitational field, said artificial gravity field being created by rotating the air/fuel mixture around an axis substantially orthogonal to the general direction followed by the combusted gases on their way out of the combustion region;

preventing the fuel particles from contacting the walls surrounding the fuel burning process by means of balancing the centrifugal forces acting on the particles and caused by the artificially created gravity field against the opposing aerodynamic forces also acting on the particles and which are caused by the means for introducing some of the air for burning the fuel;

segregating the fuel burning along the path followed by the particles as they burn and proceed toward the combustion system exhaust, and away from the walls around said combustion region;

elongating the pathway generally followed by the particles during the burning process, thereby increasing their residence time in the combustion region until their burning is generally completed before the particles leave the combustion system; and exhausting the combusted gases.

2. The method recited in claim 1 and comprising the further steps of:

forming an integral continuous structural shell exhibiting the shape of a surface of revolution by connecting the walls enclosing and containing the combustion region;

equipping the structural shell walls with air injecting nozzles positioned to direct the air jet emerging therefrom tangentially to the internal surface of the walls;

introducing a plurality of primary air flows at high velocity in a direction substantially orthogonal to the axis of symmetry of the surface of revolution of the structural shell and adjacently to said surface;

introducing a plurality of secondary air flows at lower velocity in a direction parallel to that of the primary air flows and adjacently thereto in a manner such that the primary air flows are located between the structural shell walls and the secondary air flows;

dispersing the particulate fuel in the secondary air flows;

introducing tertiary air flows tangentially to the internal surface of the structural shell walls;

positioning the nozzles injecting the tertiary air flows in a manner such that the combustion region is always isolated from the shell walls;

causing the air from the primary air flows to mix and transverse the secondary air flows thus creating turbulence and the fluidized bed effect, thereby generating the combustion region;

causing the air from the tertiary air flows to mix and interact with the partially combusted gases and some still unburned particles to complete the burning process of said particles;

forming a channel within the structural shell by means of two structures attached to the structural shell for guiding the mixture of partially combusted gases and still unburned particles out of the combustion region into the exhaust ducting formed by one of these two attached structures;

ducting some of the output flow of an air blower to a fuel metering and dispersing mechanism through which the sum total flow of the secondary air passes;

ducting the balance of the air blower output flow to a compressor which supplies the high pressure air for all air flows, except the secondary air flows; and regulating the total air flow output rate of the air blower, the total flow rates of the primary air, of the tertiary air and the flow rates of the fuel delivery and of the secondary air.

3. The method recited in claim 2 and comprising the further steps of:

adjusting the flow rate of the primary air by controlling the pressure at which the primary air is supplied to its injecting nozzles;

adjusting the flow rate of the tertiary air by controlling the pressure at which the tertiary air is supplied to its injecting nozzles;

adjusting the total flow rate delivered by the air blower, thereby substantially adjusting the flow rate of the secondary air, by controlling its rotational speed;

adjusting the ratio between the sums of the primary air flows and of the secondary air flows for each and every adjustments of the total air flow delivered by the blower and of the rate of delivery of the particulate fuel, whereby the operating conditions of the fluidized bed are thus determined; and adjusting the rate of delivery of the particulate fuel into the secondary air by means of a rotary mechanism;

whereby the heat output rate of the combustion system, the average temperature of the exhausting combusted gases and the pollutant content of the combusted gases are determined for all sets of adjustments of the three air flow rates and of the particulate fuel delivery rate.

4. The method recited in claim 3 and comprising the further steps of:

inputing a first signal representative of the heat output rate needed, a second signal representative of the average temperature of the exhausting combustion gases and a third signal representative of the acceptable upper limit of the pollutant content, said signals constituting the specific performance demands made of the combustion system;

computing the four air flow rates (total, primary, tertiary and secondary) and the fuel delivery rate which are all needed to meet the inputed performance demands;

sending command signals to: (1) the valves regulating the flow rates of the primary and tertiary air, (2) the air blower driving means for obtaining the correct sum total of all air flows, and (3) the particulate fuel delivery mechanism;

sensing the average temperature of the exhausting combusted gases and receiving the corresponding feedback signal, said signal being representative of the average temperature detected in the exhausting combusted gases;

detecting the pollutant content of the combusted gases and receiving the corresponding feedback signal, said signal being representative of the average content of pollutants contained in the exhausting combusted gases; and computing the corrections in the: (1) adjustments of the ratio between primary and secondary air flow rates, (2) adjustment of the particulate fuel delivery rate, and (3) adjustment of the blower air flow output rate, said corrections and adjustments being function of the computed differences then existing between the input demand values and the values received from the feedback signals, and adjusting the command signals accordingly.

5. The method recited in claim 1 and comprising the further steps of:

rotating the walls surrounding the combustion region, said rotating walls including an outer wall and an inner wall, thereby causing the air/fuel mixture to gyrate during substantially the entire residence time of the fuel in the combustion region;

separating large particles automatically from smaller particles within the combustion region;

increasing the length of the path followed by large particles in comparison with the length of the path followed by smaller particles on their collective way out of the combustion system, thus causing the residence time of large particles to be longer than that which characterizes smaller particles;

guiding, positioning and restraining the rotating walls within the fixed stationary walls supporting the structure of the combustion system;

preventing automatically solid contact between the rotating walls and the fixed stationary walls and supporting structure of the combustion system;

driving the rotating walls with part of the air to be introduced later in the combustion region; and causing part of the air introduced in the combustion region to flow in a direction opposite to that which the particles are prompted to follow by the artificially induced gravity field to which the particles are subjected, thus creating the force balancing effect upon the particles.

6. The method recited in claim 5 and comprising the further steps of:

adjusting the direction of the air being introduced into the space located around the rotating walls by means of a plurality of guide vanes;

receiving the impulse generated by the air having passed the guide vanes, and which is generally directed orthogonally to the axis of rotation of the rotating walls, by means of a plurality of turbine blades formed on part of the surface of said walls; and allowing most of the air impinging on said blades to flow around the rotating walls by means of lateral openings located between the guide vane assembly and the blade assembly contour.

7. The method recited in claim 6 and comprising the further steps of:

allowing the air flowing between the rotating walls and the fixed stationary walls to permeate through the rotating walls throughout most of the external surface area of said walls;

causing the air having thus permeated said walls to emerge inwardly perpendicularly to the surfaces of said rotating walls, thereby providing the aerodynamic balancing forces; and varying and programming the degree of permeation allowed to the air according to the location on the rotating all surface in a manner such that the force balancing effects on the particles are the same regardless of the site location that the particles approach on their induced outwardly directed motions.

8. The method recited in claim 7 and further comprising the steps of:

supporting and centering the rotating walls radially by means of two circular air bearings located at each end of said walls;

supporting and restraining the rotating walls axially by means of one flat air bearing located near the end of said walls where the air and the fuel are introduced, the plane of said flat bearing being oriented perpendicularly to the axis of rotation of said walls;

generating differential air pressures acting by means of said bearings upon the rotating wall surfaces, thus automatically creating restoring forces applied onto said walls and which are oriented in a direction opposite to that of the wall displacements which caused the creation of said pressure differentials; and sealing the air bearings to prevent substantially all leakage of air and combusted gases outside of the rotating walls.

9. The method recited in claim 5 and comprising the further steps of:

forming one long primary pathway for large particles and one shorter secondary pathway for the smaller particles, the primary pathway being located and wrapped around the secondary pathway, whereby the particles are allowed to move radially inwardly from the primary pathway into the secondary pathway as they burn and thusly become more sensitive to the aerodynamic forces;

generating a substantial aerodynamic friction directed tangentially to the rotating walls between said walls and the air/fuel mixture, thereby imparting their rotational momentum to the air/fuel mixture inside the combustion region; and introducing the fuel in the combustion region by means of an air jet at an angle and at a velocity such that the particles are caused to move radially outwardly into the combustion region, whereby initiating the formation of the fluidized bed.

10. The method recited in claim 5 and comprising the further steps of:

separating substantially all of the air introduced inside the combustion region into a primary air flow introduced through the outer rotating wall, a secondary air flow used to introduce the fuel, and a tertiary air flow introduced through the inner rotating wall; and regulating said air flows, whereby the fuel particles are optimally burned while residing in the combustion region.

11. The method recited in claim 10 and comprising the further steps of:

establishing the three air flow values required to optimally burn the fuel as characterized by its physical and chemical properties for obtaining the heat production level needed while limiting the production of pollutants in the combusted gases and without exceeding the limit also specified for the exhausting combusted gases;

establishing the fuel mass flow required to obtain the heat production level needed of the combustion system;

determining the mass flow value of each one of the three air flows, the ratios and sums of these values;

maintaining said air mass flows, sums and ratios thereof, and fuel mass flow at said determined values; and using a Central Processing Unit (CPU) for processing and monitoring the various signals received by the CPU, for determining, generating and monitoring the various command signals that are sent to the mechanisms utilized to meter the fuel mass flow and the three air mass flows;

whereby the heat flow, the pollutant production and the average temperature of the exhaust combusted gases are automatically controlled for each heat production levels specified.

12. The method recited in claim 11 and comprising the further steps of:

computing by means of the CPU the angular velocity of the rotating walls for establishing the optimum average residence time of the fuel particles in the combustion region;

generating the signal to the mechanism that adjusts the guide vane angular position for setting the vanes at an angle which causes the rotating walls to reach and maintain said angular velocity as required, depending on the air mass flows needed; and generating the signals to the combustion system air and fuel supplies for obtaining and maintaining the total air mass flow and the fuel mass flow required.

13. The method recited in claim 12 and comprising the further steps of:

comparing by means of the CPU the values given to the inputed signals to the values of the signals sensed by various sensors and received (output) by the CPU;

computing and generating the command signals sent to the control mechanisms as a function of the value of the differences resulting from said signal comparison by the CPU;

initiating and monitoring the start of the burning process in the combustion system by means of an ignition fuel system;

detecting the ignition of the particulate fuel in the combustion region; and stopping the operation of the ignition fuel system automatically when the burning of the particulate fuel has become self sustaining.

14. The method recited in claim 13 and comprising the further steps of:

channelling the flow of the mixture of partially combusted gases and partially combusted fuel particles on its way toward the exhaust along a conically shaped path which comes closer to the axis of gyration of the rotating walls as said mixture approaches the exhaust vent of the combustion system;

whereby particles of diminishing size are then subjected to centrifugal forces of smaller magnitude which requires correspondingly decreasing aerodynamic forces applied onto said particles to balance these centrifugal forces of smaller magnitude, and whereby, as the particules burn and become smaller, they automatically migrate from the longer primary pathways to the shorter secondary pathways and closer to the inner rotating wall where said particles are exposed to fresh air, which facilitates the completion of the combustion process of said particles.

* * * * *